US007580834B2

(12) United States Patent
Ehara et al.

(10) Patent No.: US 7,580,834 B2
(45) Date of Patent: Aug. 25, 2009

(54) FIXED SOUND SOURCE VECTOR GENERATION METHOD AND FIXED SOUND SOURCE CODEBOOK

(75) Inventors: Hiroyuki Ehara, Yokohama (JP); Kazutoshi Yasunaga, Kyoto (JP); Kazunori Mano, Nerima-ku (JP); Yusuke Hiwasaki, Higashiyamato (JP)

(73) Assignees: Panasonic Corporation, Osaka (JP); Nippon Telegraph and Telephone Corporation, Tokyo (JP)

( * ) Notice: Subject to any disclaimer, the term of this patent is extended or adjusted under 35 U.S.C. 154(b) by 817 days.

(21) Appl. No.: 10/505,100

(22) PCT Filed: Feb. 20, 2003

(86) PCT No.: PCT/JP03/01882

§ 371 (c)(1),
(2), (4) Date: Aug. 19, 2004

(87) PCT Pub. No.: WO03/071522

PCT Pub. Date: Aug. 28, 2003

(65) Prior Publication Data

US 2005/0228652 A1 Oct. 13, 2005

(30) Foreign Application Priority Data

Feb. 20, 2002 (JP) ..... 2002-043878

(51) Int. Cl.
*G10L 19/00* (2006.01)

(52) U.S. Cl. ..... 704/221

(58) Field of Classification Search ..... 704/221–224
See application file for complete search history.

(56) References Cited

U.S. PATENT DOCUMENTS 4,868,867 A * 9/1989 Davidson et al. ..... 704/200.1

(Continued)

FOREIGN PATENT DOCUMENTS

EP 967594 12/1999

(Continued)

OTHER PUBLICATIONS

M.R. Schroeder, et al; "Code-Excited Linear Prediction (CELP): High Quality Speech at Very Low Bit Rates", CH2118-8/85/0000-0937, pp. 937-940, 1985 IEEE.

(Continued)

*Primary Examiner*—Michael N Opsasnick
(74) *Attorney, Agent, or Firm*—Dickinson Wright, PLLC

(57) ABSTRACT

At the speech encoding end, upon generation of an fixed excitation vector, the shape of an excitation vector output from pulse excitation codebook 301 is identified in pulse excitation vector shape identifier 302, a dispersion vector used for excitation vectors of the shape is output from dispersion vector storage 304, and, in dispersion vector convolution processor 303, dispersion vector convolution processing of the excitation vector is performed. In particular, when a pulse excitation vector having a specific shape of high frequency of use is output from pulse excitation codebook 301, pulse excitation vector shape identifier 302 controls dispersion vector storage 304 in such a way that an additional dispersion vector prepared dedicated to the pulse excitation vector is output. By this means, it is possible to provide a technology that improves the quality of decoded speech and that decodes speech more natural and audible to the user.

2 Claims, 17 Drawing Sheets

U.S. PATENT DOCUMENTS

| | | | | | |
|---|---|---|---|---|---|
| 5,195,137 | A * | 3/1993 | Swaminathan | ..... | 704/222 |
| 5,307,441 | A * | 4/1994 | Tzeng | ..... | 704/222 |
| 5,734,790 | A * | 3/1998 | Taguchi | ..... | 704/216 |
| 5,826,226 | A * | 10/1998 | Ozawa | ..... | 704/223 |
| 5,963,896 | A * | 10/1999 | Ozawa | ..... | 704/219 |
| 6,122,608 | A * | 9/2000 | McCree | ..... | 704/219 |
| 6,330,534 | B1 * | 12/2001 | Yasunaga et al. | ..... | 704/223 |
| 6,330,535 | B1 * | 12/2001 | Yasunaga et al. | ..... | 704/223 |
| 6,345,247 | B1 * | 2/2002 | Yasunaga et al. | ..... | 704/219 |
| 6,377,915 | B1 | 4/2002 | Sasaki | | |
| 6,385,573 | B1 | 5/2002 | Gao et al. | | |
| 6,415,254 | B1 * | 7/2002 | Yasunaga et al. | ..... | 704/223 |
| 6,496,796 | B1 | 12/2002 | Tasaki et al. | | |
| 7,024,356 | B2 * | 4/2006 | Yasunaga et al. | ..... | 704/223 |

FOREIGN PATENT DOCUMENTS

| | | |
|---|---|---|
| EP | 1132892 | 9/2001 |
| JP | 08123495 | 5/1996 |
| JP | 8202399 | 8/1996 |
| JP | 10063300 | 3/1998 |
| JP | 11282497 | 10/1999 |
| JP | 2000267700 | 9/2000 |
| JP | 2000347700 | 12/2000 |
| JP | 2001075600 | 3/2001 |
| JP | 2001134298 | 5/2001 |
| JP | 2001142500 | 5/2001 |
| WO | 0011660 | 3/2000 |

OTHER PUBLICATIONS

K. Yasunaga, et al; "Dispersed-Pulse Codebook and its Application to a 4KB/S Speech Coder", O-7803-6293-4/00, pp.1503-1506, 2000 IEEE.

J-H. Chen, et al; "Adaptive Postfiltering for Quality Enhancement of Coded Speech", IEEE Transactions on Speech & Audio Processing, vol. 3, No. 1, pp. 59-71, Jan. 1995.

International Search Report dated Apr. 22, 2003; PCT/ISA/210; PCT/JP03/01882.

* cited by examiner

FIXED SOUND SOURCE VECTOR GENERATION METHOD AND FIXED SOUND SOURCE CODEBOOK

TECHNICAL FIELD

The present invention relates to a fixed excitation vector generation method and a fixed excitation codebook for use in a CELP type speech encoder or a CELP type speech decoder.

BACKGROUND ART

In such fields as digital communication, packet communication typified by Internet communication, and speech storage, speech signal encoders are used to compress speech information so as to make efficient use of radio wave transmission path capacity and storage media and thus encoding at high efficiency.

Among these, methods based on the CELP (Code Excited Linear Prediction) method are widely used at intermediate and low rates in practice. A CELP technique that uses pulse excitation as a drive excitation signal is described in "Code-Excited Linear Prediction (CELP): High-quality Speech at Very Low Bit Rates" by M. R. Schroeder and B. S Atal, Proc. ICASSP-85, 25.1.1., pp.937-940, 1985.

In a CELP type speech encoding method, a digitized speech signal is divided into frames of a fixed frame length (approximately 5 ms-50 ms), linear prediction of speech is performed on a per frame basis, and linear prediction residual (excitation signal) from the linear prediction performed on a per frame basis is encoded using an adaptive codebook and a fixed codebook (including a stochastic codebook, random codebook, noise codebook and so on) composed of known waveforms.

The adaptive codebook holds drive excitation signals generated in the past and is used to represent a cyclic component of a speech signal. The fixed codebook holds a predetermined number of vectors, provided in advance and having predetermined shapes, and is chiefly used to represent a non-cyclic component that cannot be represented with the adaptive codebook.

As for the vectors stored in the fixed codebook, vectors composed of random noise sequence and/or vectors represented by combining a number of pulses are used.

A typical example of a fixed codebook that represents a vector by combining a number of pulses is the algebraic fixed codebook. The algebraic fixed codebook is described in detail, for example, in ITU-T Recommendation G.729 Annex-D. The algebraic fixed codebook has the advantage of searching a fixed excitation codebook at a small computation amount and reducing the capacity in ROM that holds excitation vectors. Still, the problem regarding difficulty of accurate code representation of a noise component persists.

One method for solving this problem with the algebraic fixed codebook is the technique of using a pulse dispersion-dispersion technique. Pulse dispersiondispersion is disclosed in ITU-T Recommendation G.729 Annex-D. This pulse dispersiondispersion is a method for generating a fixed excitation vector by convoluting a dispersiondispersion pattern (fixed waveform) in an excitation vector.

FIG. 1 is a block diagram showing an example of configuration of a fixed excitation codebook having a conventional pulse dispersiondispersion structure. dispersiondispersed pulse codebook 10 comprises pulse excitation codebook 11, dispersiondispersion vector convolution processor 12, and dispersiondispersion vector storage 13.

An excitation vector is output from pulse excitation codebook 11, and a dispersiondispersion vector, taken from dispersiondispersion vector storage 13, is convoluted with this pulse excitation vector in dispersion vector convolution processor 12, thereby generating a fixed excitation vector (noise excitation vector).

It is possible to improve the performance of the pulse excitation codebook at low bit rates such as below 4 kbit/s by conventional pulse dispersion.

Still, greater quality improvement (that is, further improving the quality of decoded speech) will be required in next-generation mobile telephone systems, and it is difficult to meet such demand with existing technologies.

For instance, simply increasing the patterns of dispersion vectors does not improve the quality of decoded speech, and increasing the patterns of dispersion vectors thus has the threat of increasing the capacity in a memory and making signal processing complex.

DISCLOSURE OF INVENTION

It is therefore an object of the present invention to provide a technique that further enhances the quality of decoded speech by improving the quality of speech at the encoding end and the decoding end of speech, and that decodes speech more natural and audible to the user.

The above object is achieved, when a fixed excitation vector is generated at the speech encoding end, by selecting in advance a pulse excitation vector of a specific shape with high frequency of use from among many pulse excitation vectors, and preparing a dedicated dispersion vector corresponding to the selected pulse excitation vector.

In addition, the above object is achieved by, at the speech decoding end, applying high-frequency emphasis processing of novel and ingenious characteristics to an excitation signal (a signal that imitates speech that originates in man's vocal tract) before being input to a synthesis filter (having functions that imitate man's vocal tract).

BEST MODE FOR CARRYING OUT THE INVENTION

With reference now to the accompanying drawings, embodiments of the present invention will be explained in detail below.

First, the overall configuration of a sound signal transmitting apparatus and a sound signal receiving apparatus of the present invention will be explained with reference to FIG. 2.

Figure 1:
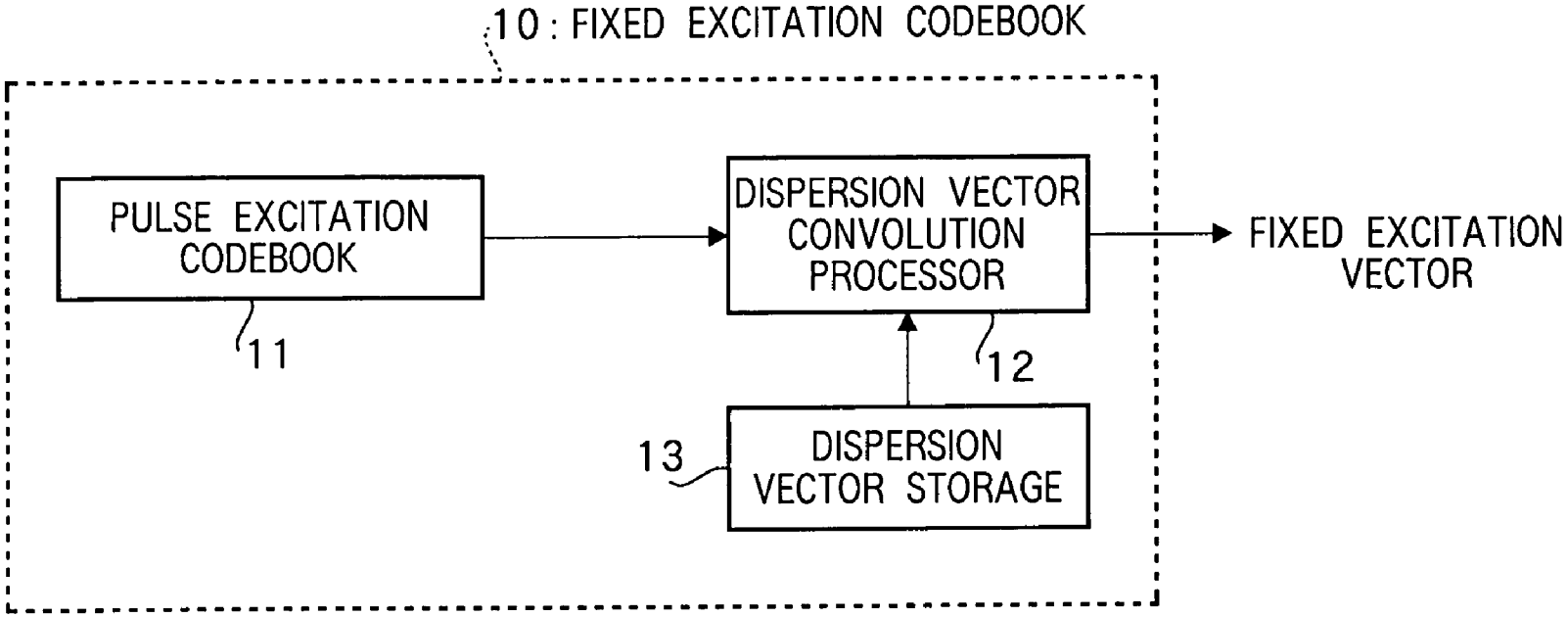
PRIOR ART FIG. 1
FIG. 1 is a block diagram showing an example of configuration of a fixed excitation codebook having conventional pulse dispersion mechanism.
Figure 2:
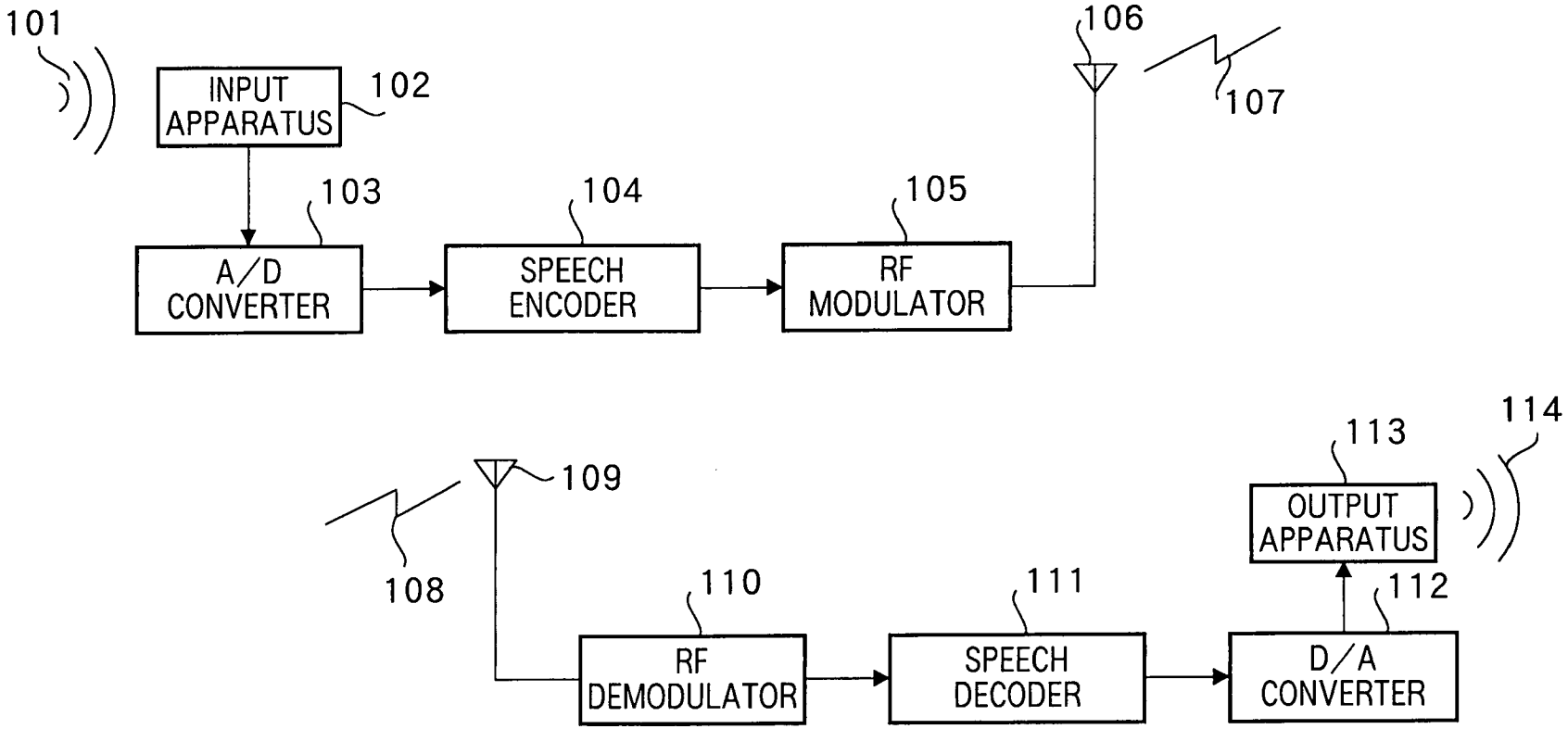
FIG. 2 is a drawing showing a simplified overall configuration of a speech signal transmitting apparatus and a speech signal receiving apparatus according to the present invention.

In FIG. 2, speech signal 101 is converted to an electrical signal by input apparatus 102, and is then output to A/D converter 103. A/D converter 103 converts the (analog) signal output from input apparatus 102 to a digital signal, and outputs this signal to speech encoder 104. Speech encoder 104 encodes the digital speech signal output from A/D converter 103 using a speech encoding method described later herein, and outputs encoded information to RF modulator 105. RF modulator 105 places the speech encoded information output from speech encoder 104 on a propagation medium such as a radio wave, converts the signal for sending, and outputs it to transmitting antenna 106. Transmitting antenna 106 sends out the output signal output from RF modulator 105 as a radio wave (RF signal). RF signal 107 in the drawing is a radio wave (RF signal) transmitted from transmitting antenna 106. The above is the configuration and operation of the speech signal transmitting apparatus.

RF signal 108 is received by receiving antenna 109 and output to RF demodulator 110. RF signal 108 in the drawing is a radio wave as received by receiving antenna 109 and, if there is no signal attenuation or noise superimposition in the propagation path, is exactly the same as RF signal 107.

RF demodulator 110 demodulates speech encoded information from the RF signal output from receiving antenna 109, and outputs this information to speech decoder 111. Speech decoder 111 decodes a speech signal from the speech encoded information output from RF demodulator 110 using a speech decoding method described later herein, and outputs the resulting signal to the D/A converter 112. D/A converter 112 converts the digital speech signal output from speech decoder 111 to an analog electrical signal, and outputs this signal to output apparatus 113. Output apparatus 113 converts the electrical signal to vibrations of the air, and outputs sound waves that are audible to the human ear. In the figure, the reference number 114 indicates sound waves that are output. The above is the configuration and operation of the speech signal receiving apparatus.

By providing at least one of the above-described kinds of speech signal transmitting apparatus and receiving apparatus, it is possible to configure a base station apparatus and mobile terminal apparatus in a mobile communication system.

Now, with reference to the drawings, improvement of generation of fixed excitation vectors using dispersion vectors at the speech encoding end (First Embodiment) and high-frequency emphasis processing at the speech decoding end (Second Embodiment) will be described in order.

First Embodiment

A case will be described here in the first embodiment where, in a fixed excitation codebook, a dedicated dispersion vector is provided for a pulse excitation vector of a predetermined shape, and an optimum dispersion vector is applied depending on the shape of the pulse excitation vector.

Figure 3:
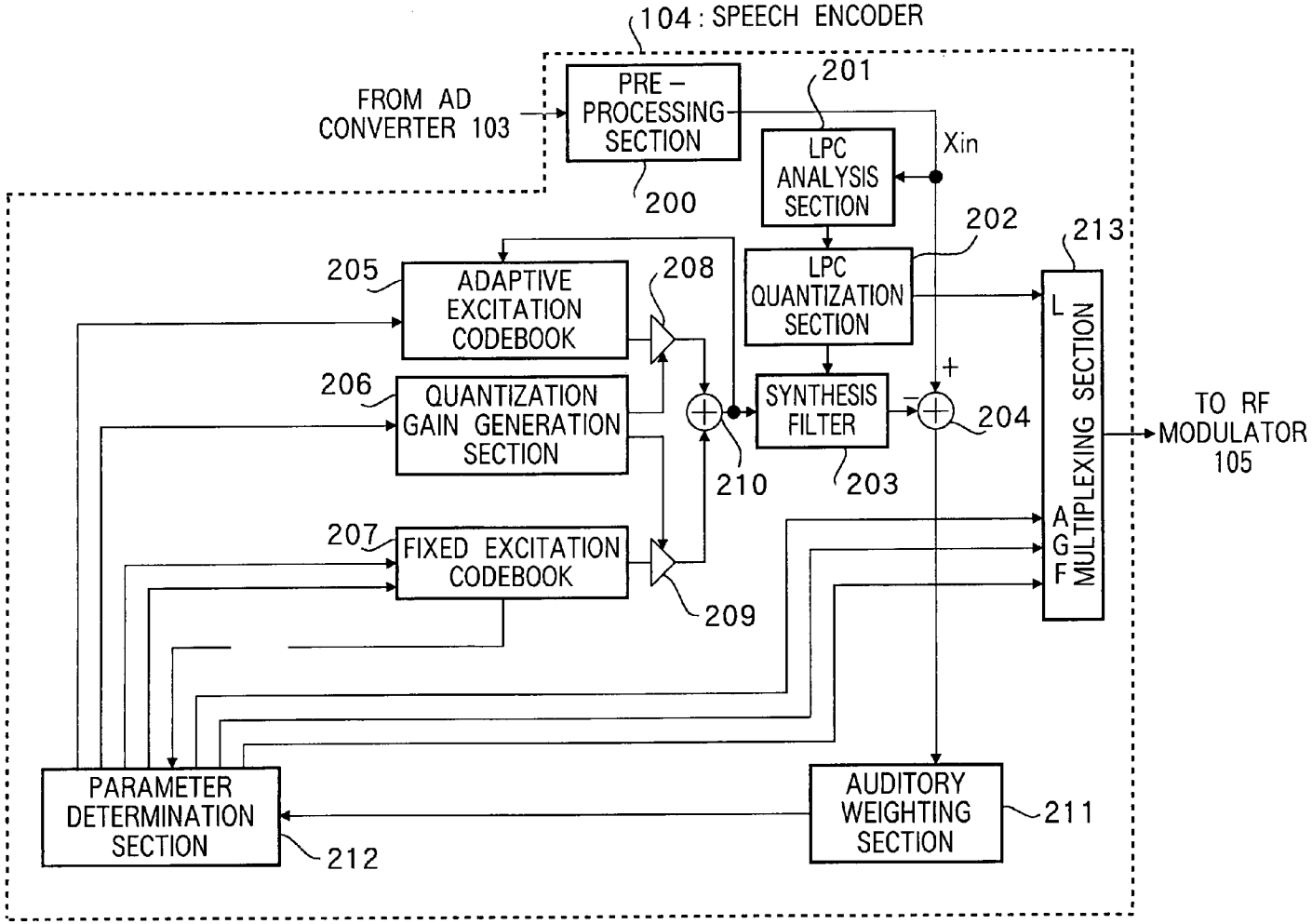
FIG. 3 is a block diagram showing a configuration of a speech encoder according to the first embodiment of the present invention.

FIG. 3 is a block diagram showing a configuration of speech decoder 104 mounted in the speech signal transmitting apparatus of FIG. 2.

An input signal in speech encoder 104 is a signal output from A/D converter 103, and is input to preprocessing section 200. Preprocessing section 200 performs high-pass filter processing that eliminates the DC component in the input speech signal, or waveform shaping processing and pre-emphasis processing concerned with improving the performance of later encoding processing, and outputs the processed speech signal (Xin) to LPC analysis section 201 and adder 204.

LPC analysis section 201 performs linear predictive analysis using Xin, and outputs the result of the analysis (linear predictive coefficient) to LPC quantization section 202. LPC quantization section 202 performs quantization processing of the linear predictive coefficients (LPC), and outputs the quantized LPC to synthesis filter 203 while outputting code L indicating the quantized LPC to multiplexing section 213.

Synthesis filter 203 generates a reconstructed signal by filter-synthesizing a drive excitation output from adder 210, explained later herein, using LPC coefficients based on the quantized LPC, and outputs the reconstructed signal to adder 204.

Adder 204 calculates an error signal for aforementioned Xin and the aforementioned reconstructed signal, and outputs this error signal to auditory weighting section 211. Auditory weighting section 211 performs auditory weighting on the error signal output from adder 204, calculates distortion between Xin and the reconstructed signal in the auditory weighting domain, and outputs this distortion to parameter determination section 212.

Parameter determination section 212 selects an adaptive excitation vector, a fixed excitation vector, and a quantization gain that minimize the above encoding distortion from adaptive excitation codebook 205, fixed excitation codebook 207 and quantization gain generation section 206, and outputs adaptive excitation vector code (A), excitation gain code (G) and fixed excitation vector code (F) that indicate the result of the selection, to multiplexing section 213. In addition, when the shape of a pulse excitation vector selected in fixed excitation codebook 207 is a predetermined specific shape, selection of the best dispersion vector is performed from the set of additional dispersion vectors prepared for the specific shape vector. Parameter determination section 212 checks whether there are dispersion vectors that minimize quantization error more than does the fundamental dispersion vector, and selects a dispersion vector that minimizes quantization error the most from among the fundamental dispersion vector and the additional dispersion vectors, and outputs a control signal indicating the selection result to fixed excitation codebook 207.

Adaptive excitation codebook 205 buffers drive excitation signals output by adder 210 in the past, and, from the past drive excitation signal samples specified by a signal output from parameter determination section 212, cuts one frame of samples as an adaptive excitation vector and outputs this to multiplier 208.

Quantization gain generation section 206 outputs to multipliers 208 and 209, respectively, an adaptive excitation gain and a fixed excitation gain specified by a signal output from parameter determination section 212.

Fixed excitation codebook 207 outputs to multiplier 209 a fixed excitation vector obtained by multiplying a dispersion vector upon a pulse excitation vector that has the shape specified by a signal output from parameter determination section 212. The configuration of this fixed excitation codebook 207 is a major characteristic of the present embodiment, and this characteristic part will be described later in detail.

Multiplier 208 multiplies a quantization adaptive excitation gain output from quantization gain generation section 206 upon the adaptive excitation vector output from adaptive excitation codebook 205, and outputs the result to adder 210.

Multiplier 209 multiplies the quantization adaptive excitation gain output from quantization gain generation section 206 upon the fixed excitation vector output from fixed excitation codebook 207, and outputs the result to adder 210.

Adder 210 has as inputs the adaptive excitation vector and the fixed excitation vector after gain multiplication from multipliers 208 and 209, respectively, performs vector-addition of them, and outputs a drive excitation of the addition result to synthesis filter 203 and adaptive excitation codebook 205.

Multiplexing section 213 has as inputs code L indicating the quantization LPC from LPC quantization section 202, code A indicating the adaptive excitation vector, code F indicating the fixed excitation vector, and code G indicating the quantization gain, from parameter determination section 212, multiplexes these information, and outputs them to the propagation path as encoded information.

The above explains each component part of speech encoder 104.

The detailed configuration and features of fixed excitation codebook 207 will be explained next with reference to the drawings.

Figure 4:
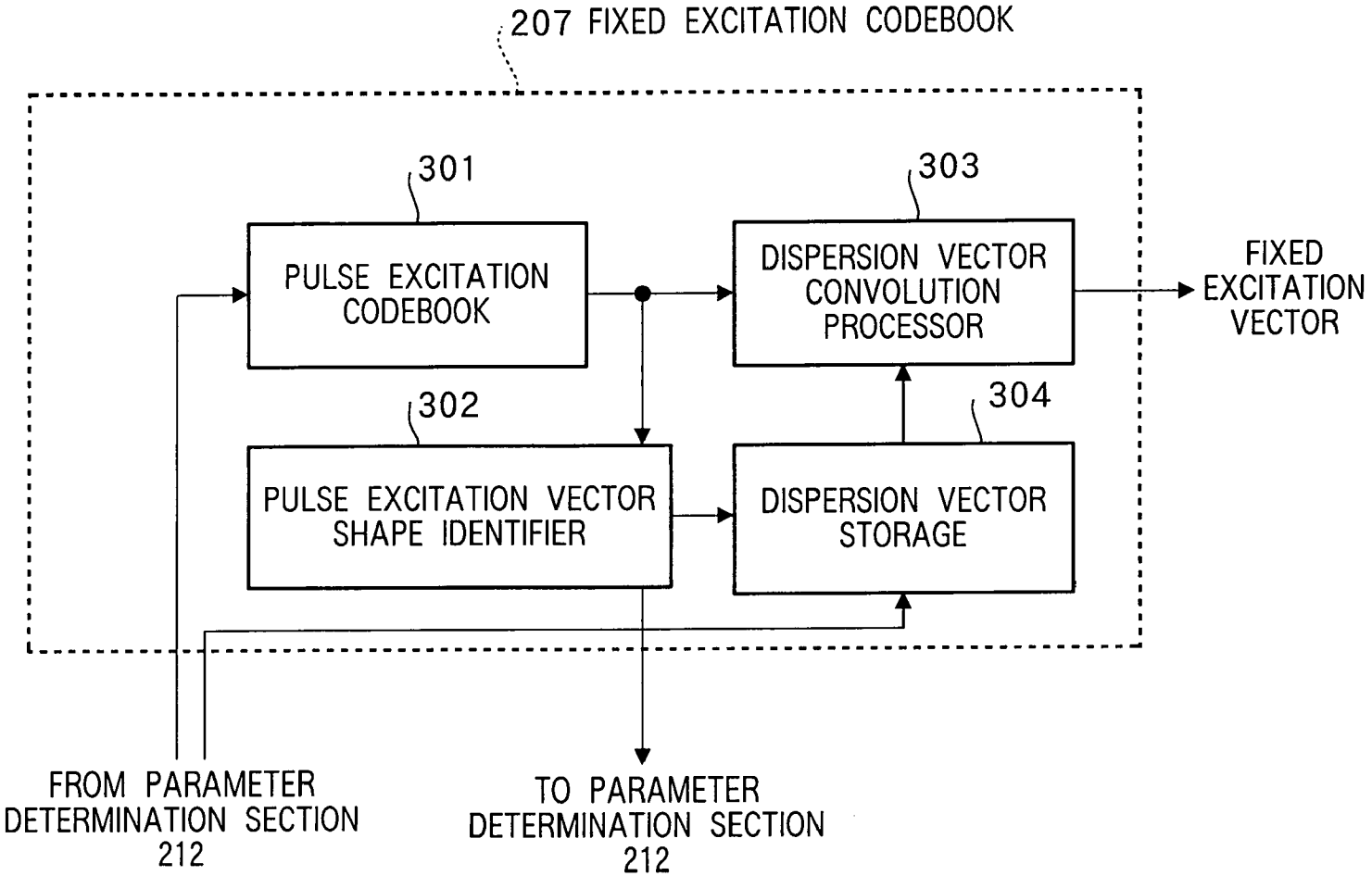
FIG. 4 is a block diagram showing a configuration of a fixed excitation codebook according to the first embodiment of the present invention.

FIG. 4 is a block diagram showing a configuration of fixed excitation codebook 207 of FIG. 3.

Referring to FIG. 4, pulse excitation codebook 301 outputs a pulse excitation vector to pulse excitation vector shape identifier 302 and dispersion vector convolution processor 303, respectively.

Pulse excitation vector shape identifier 302 associates a predetermined vector shape with parameters that specify this vector shape and memorizes them in a memory. If the pulse excitation vector consists of only several pulses, the shape is determined based on the distance between the pulses (i.e., how many samples apart they are) and the polarity relationship of the pulses (heteropolar or homopolar). In the present case, the distance between the pulses and the polarity relationship of the pulses are the parameters.

Then, pulse excitation vector shape identifier 302 compares the parameters of the pulse excitation vector output from pulse excitation codebook 301 and the parameters of each memorized vector shape, and, when for instance all the parameters match, judges that these vectors have the same shape. If the pulse excitation vector consists of only a few pulses, pulse excitation vector shape identifier 302 judges that these vectors have the same shape, provided that they share the same relative positions between the respective pulses and polarity relationship. Moreover, vectors that have the same pulse intervals and pulse polarity and that are shifted in the time axis direction, and vectors that are multiplied by a constant number in scale (pulse amplitude) are also judged to be vectors of the same shape.

When there are vectors of the same shape, pulse excitation vector shape identifier 302 outputs a control signal to dispersion vector storage 304 so as to output an additional dispersion vector designed exclusively for the pulse excitation vectors of this shape. On the other hand, when there are no vectors of the same shape, pulse excitation vector shape identifier 302 outputs a control signal to dispersion vector storage 304 so as to output a fundamental dispersion vector.

Dispersion vector storage 304 memorizes, besides the fundamental dispersion vector used commonly for all pulse excitation vectors, an additional dispersion vector used for pulse excitation vectors of a predetermined shape in a memory, and switches the dispersion vectors output to dispersion vector convolution processor 303 in accordance with the control signal from parameter determination section 212 and the control signal from excitation vector shape identifier 302. That is, dispersion vector storage 304 selects the dispersion vector that corresponds to the pulse excitation vector shape identified in pulse excitation vector shape identifier 302, and outputs it to dispersion vector convolution processor 303.

Dispersion vector convolution processor 303 convolutes the pulse excitation vector output from pulse excitation codebook 301 and the dispersion vector taken from dispersion vector storage 304. By this means, a fixed excitation vector is generated (noise excitation vector).

By this selection and convolution of an optimum dispersion vector shape in accordance with the shape of an excitation vector, it is possible to improve encoding performance compared to when a predetermined dispersion vector (one type or a plurality of types of fundamental dispersion vectors) is applied to all pulse excitation vectors.

Here, although the number of vector shapes memorized in a memory in pulse excitation vector shape identifier 302 is optional, by preparing additional dispersion vectors only for those vectors of specific shapes of high frequency of use, it is possible to narrow the number of additional vectors and minimize increase in ROM capacity that results from introduction of additional dispersion vectors.

Now, a method of selecting an excitation vector of a specific shape of high frequency of use that is memorized in advance in a memory of pulse excitation vector shape identifier 302 and a method of selecting an additional dispersion vector applied thereto will be described in detail.

Figure 5A:
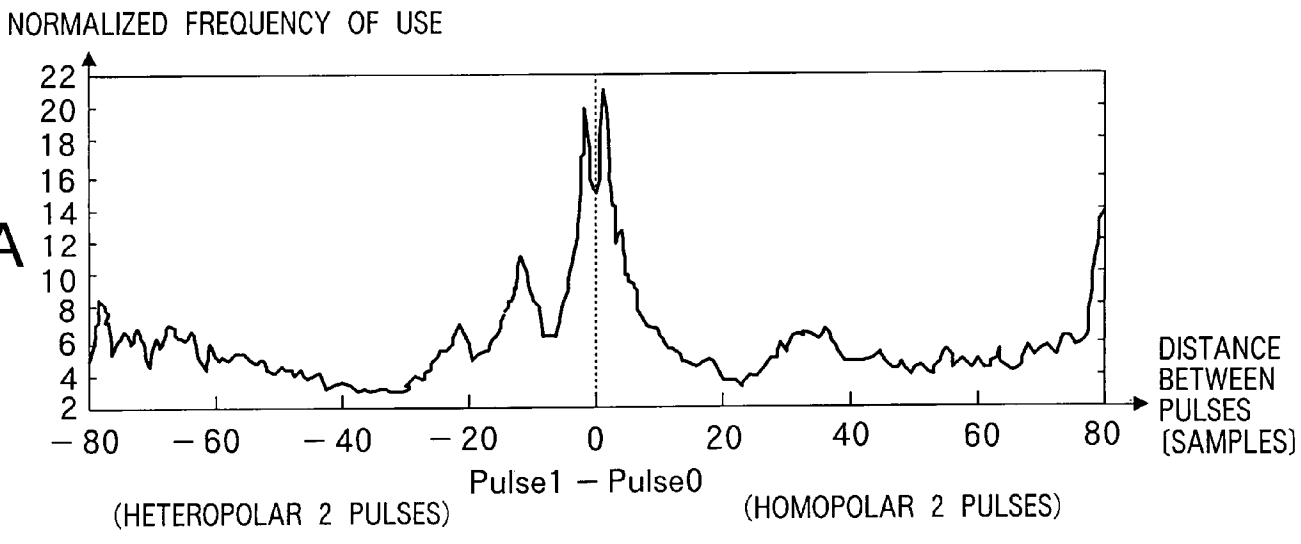
FIG. 5A is a drawing showing the distribution of the frequency of use of pulse excitation vectors according to the first embodiment of the present invention.
Figure 5B:
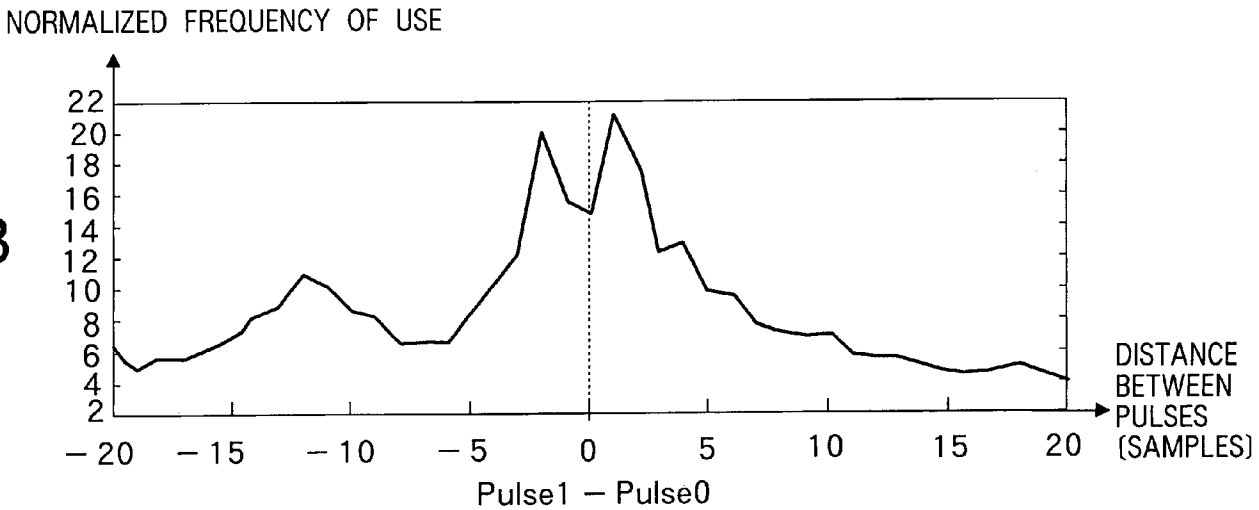
FIG. 5B is a drawing showing the distribution of the frequency of use of pulse excitation vectors according to the first embodiment of the present invention.

FIG. 5A and FIG. 5B are drawings showing the distribution of the frequency of use with respect to a pulse excitation vector (two pulses) output from pulse excitation codebook 301, based on the parameters of the distance between pulses and the polarity of each pulse, in which several hours of actually encoded speech data is collected.

FIG. 5B is a drawing that enlarges FIG. 5A in the directions of the horizontal axis. In FIGS. 5A and 5B, the horizontal axis indicates the distance between pulses (samples), and the vertical axis indicates the normalized frequency of use at which an excitation vector of a given distance between pulses is used. Moreover, in FIG. 5A and FIG. 5B, the origin, where two pulses overlap, indicates that the excitation vector contains one pulse, that the left side of the origin is combination of heteropolar pulses, and that the right side is combination of homopolar pulses.

The normalized frequency of use refers to the value obtained by dividing the number of times the pulse excitation vector of each interval is used by the number of combination of pulses in each interval. For instance, when there are a number of combinations such as when the interval is 1 sample and the first pulse is 1 sample and the second pulse is 2 samples, 2 samples and 3 samples, and so on, the frequency is normalized by the number of all the combinations that the pulse excitation codebook can generate.

As obvious from FIG. 5A and FIG. 5B, regardless of combinations of polarities, the frequency of use concentrates on excitation vectors having less than three samples of distance between two pulses.

5 types of excitation vectors are selected here in which the distance between 2 pulses is less than three samples (Distance between pulses 0, distance between pulses 1 and homopolar pulses, distance between pulses 1 and heteropolar pulses, distance between pulses 2 and homopolar pulses, distance between pulses 2 and heteropolar pulses) to be stored in a memory of pulse excitation vector shape identifier 302.

Next, for each excitation vector selected, a dedicated, additional dispersion vector is designed through learning.

The learning of dispersion vectors is performed based on the generalized Lloyd algorithm, as shown in the part of 3.1 in K.Yasunaga et. al, "Dispersed-pulse codebook and its application to 4 kb/s speech coder," Proc. ICASSP2000, pp.1503-1506, 2000, and dispersion vectors that minimize the total of encoding distortion in comparison to learning data are determined.

FIG. 6-FIG. 10 show examples of designed additional dispersion vectors, each showing a case where 4 types of additional dispersion vectors are designed for each excitation vector.

Figure 6:
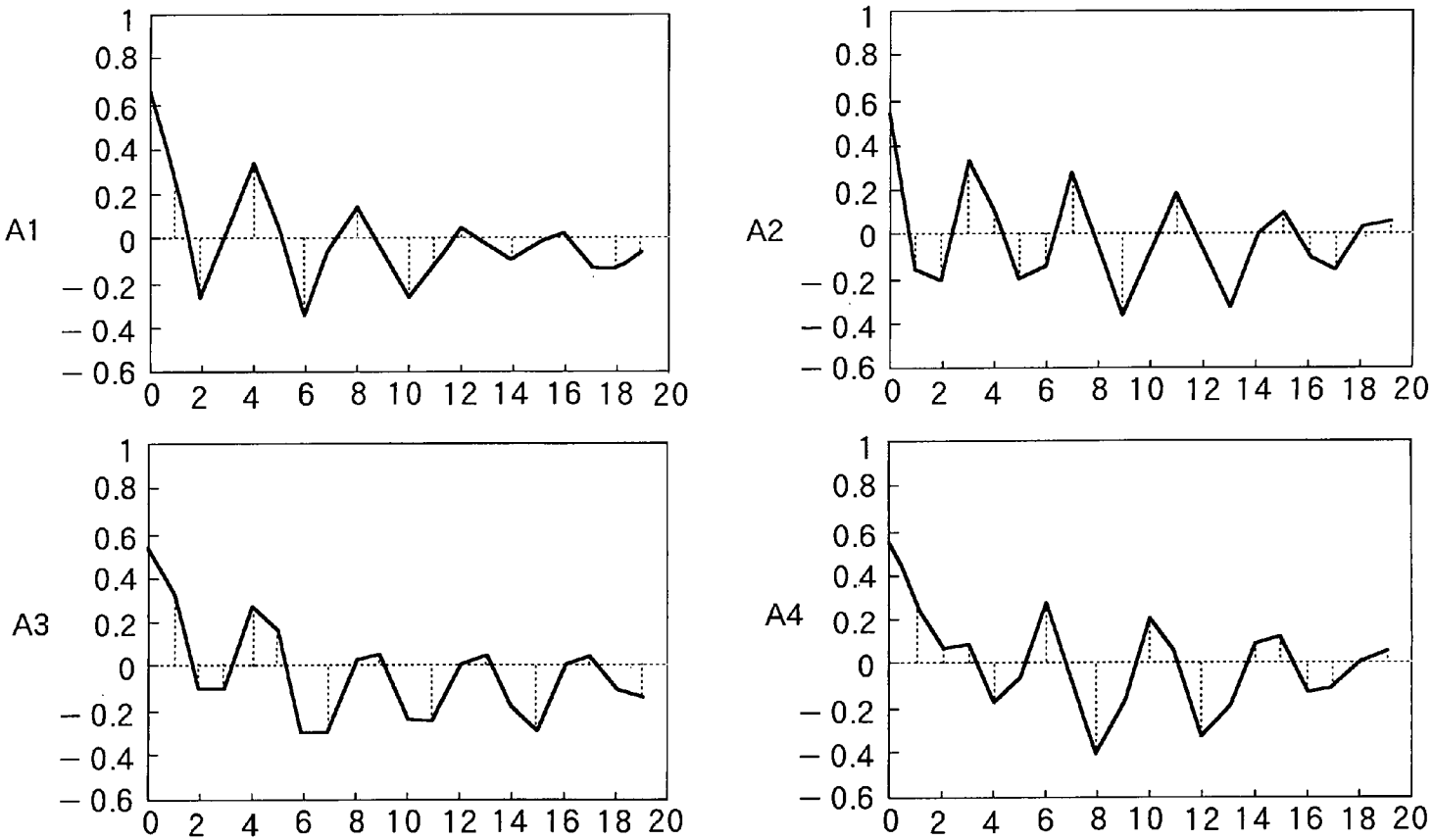
FIG. 6 is a drawing showing an example of an additional dispersion vector according to the first embodiment of the present invention.
Figure 7:
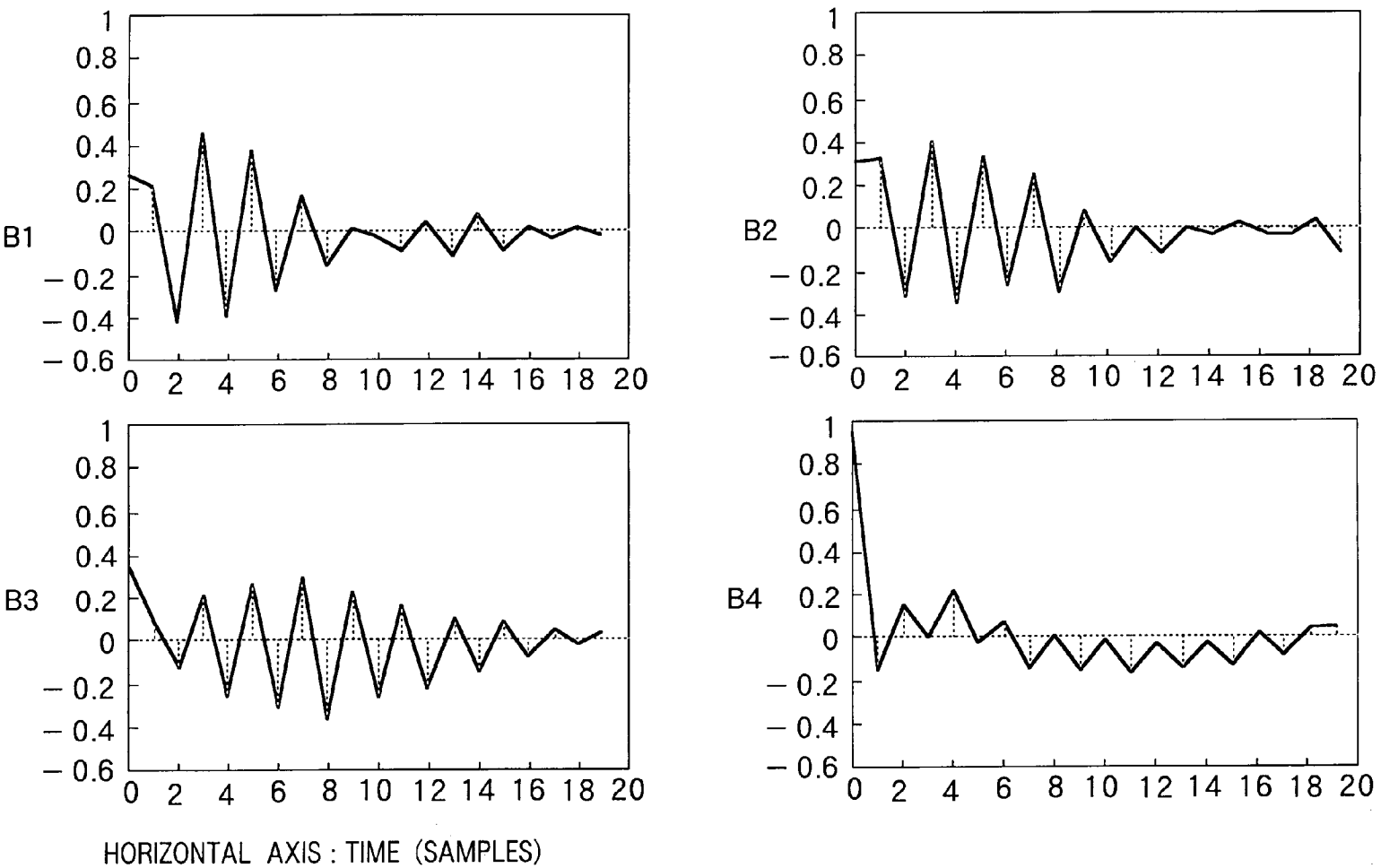
FIG. 7 is a drawing showing an example of an additional dispersion vector according to the first embodiment of the present invention.
Figure 8:
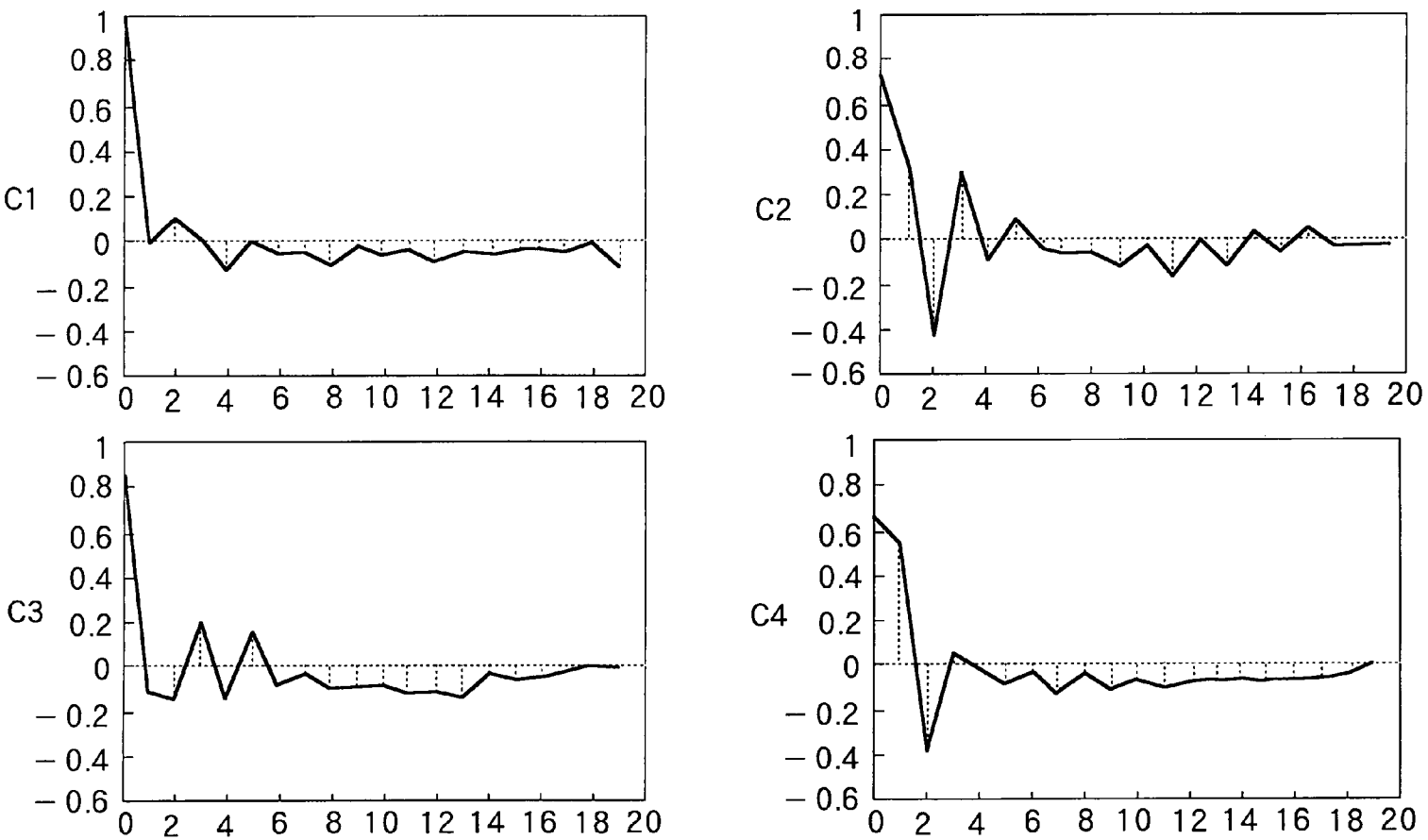
FIG. 8 is a drawing showing an example of an additional dispersion vector according to the first embodiment of the present invention.
Figure 9:
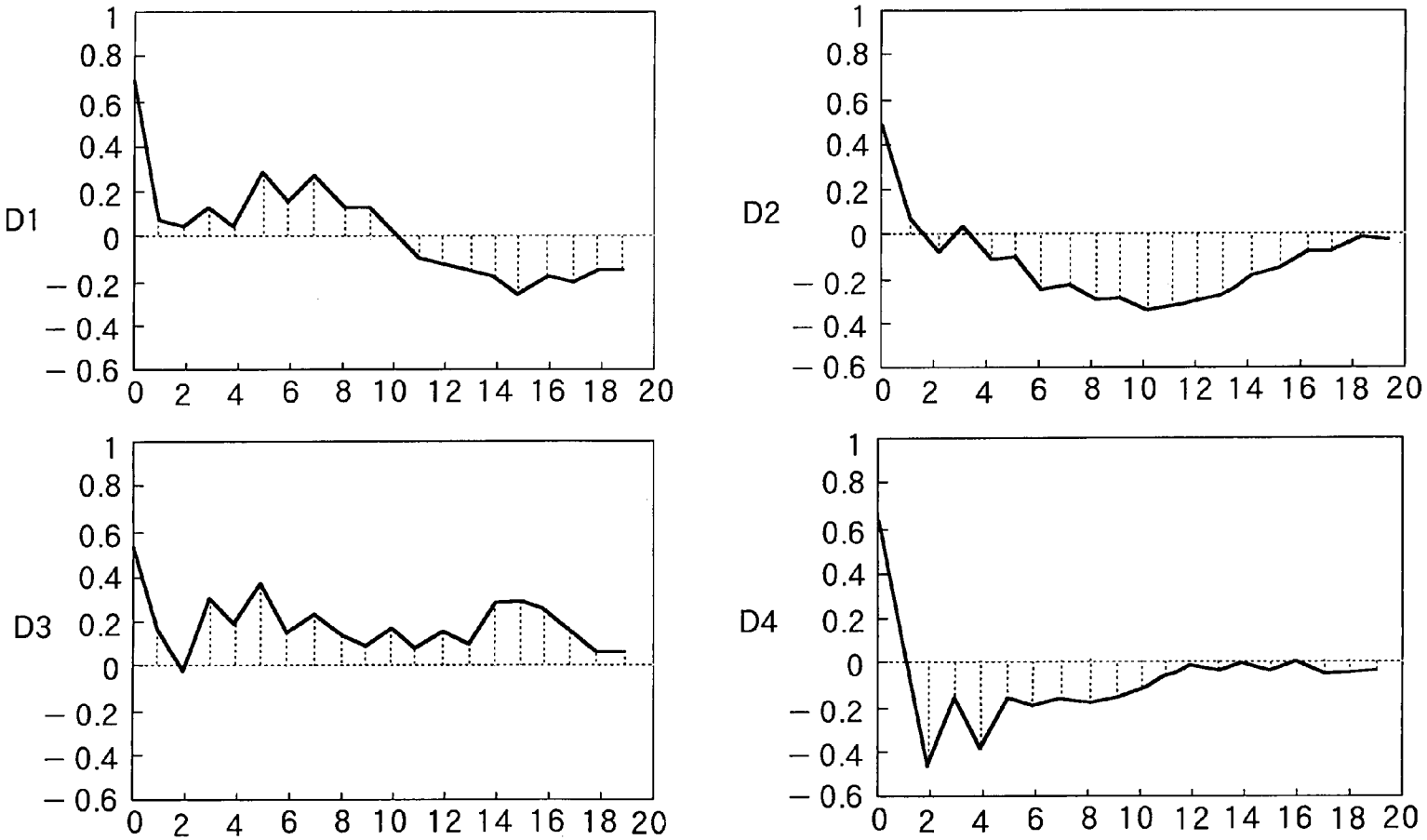
FIG. 9 is a drawing showing an example of an additional dispersion vector according to the first embodiment of the present invention.
Figure 10:
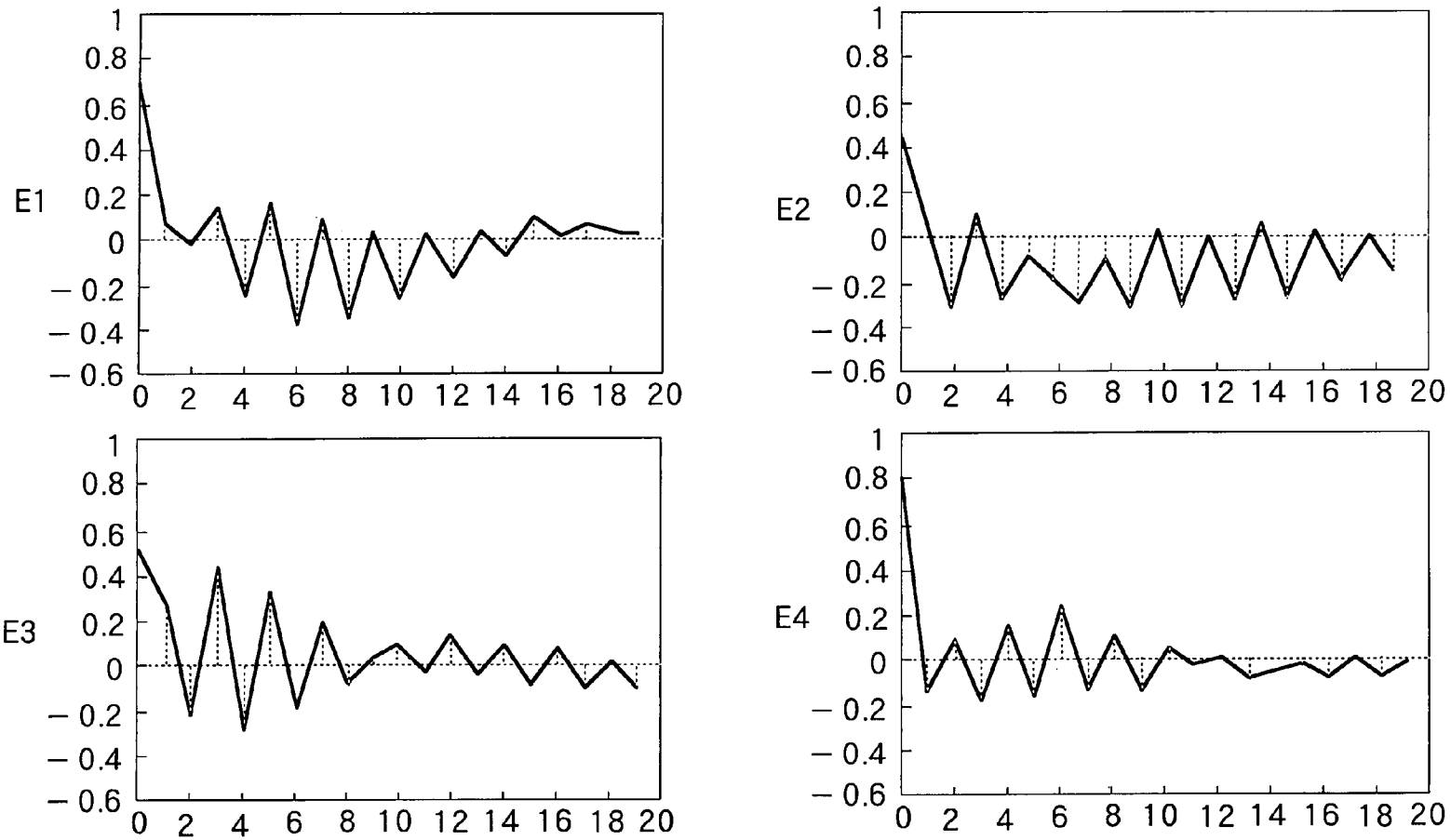
FIG. 10 is a drawing showing an example of an additional dispersion vector according to the first embodiment of the present invention.

FIG. 6 shows that four types of dedicated dispersion vectors (A1-A4) are assigned to an excitation vector having two samples of distance between pulses and homopolar pulse polarities. Similarly, FIG. 7 shows that four types of additional dispersion vectors (B1-B4) are provided for an excitation vector having one sample of distance between pulses and homopolar pulse polarities. Similarly, FIG. 8, FIG. 9, and FIG. 10 show that four types of additional dispersion vectors are provided respectively for excitation vectors having 0 sample of distance between pulses and homopolar, having 1 sample of distance between pulses and heteropolar, and having 2 samples of distance between pulses and heteropolar. As obvious from FIG. 6-FIG. 10, the shapes of the additional dispersion vectors obtained in correspondence to the 5 types of pulse excitation vectors have different features.

Figure 11:
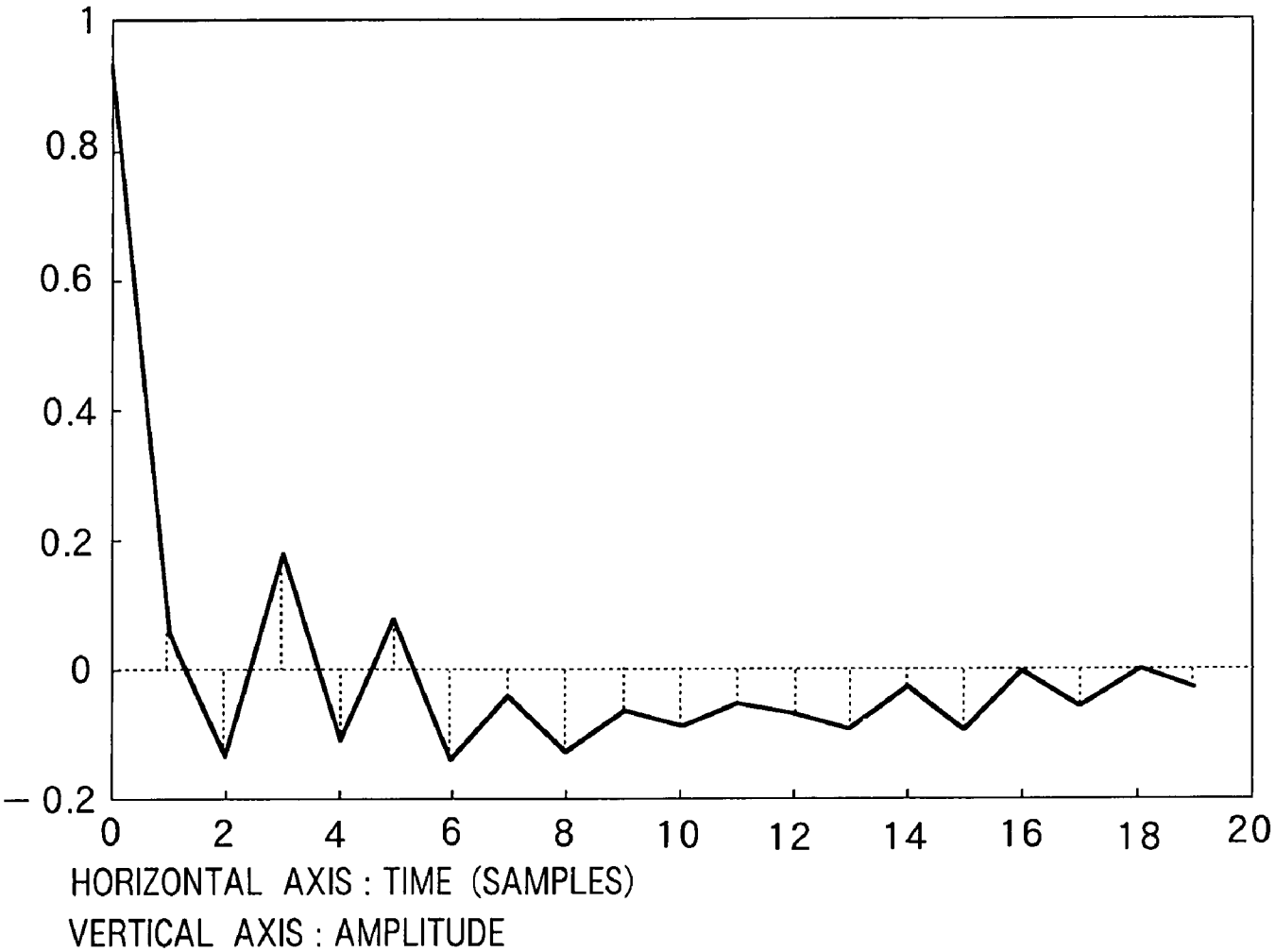
FIG. 11 is a drawing showing an example of an additional dispersion vector according to the first embodiment of the present invention.

When learning is performed using common dispersion vectors for all excitation vectors, a vector is obtained in an average shape of these dispersion vectors having different features, which sets limits to improvement of performance. An example of a fundamental dispersion vector is shown in FIG. 11.

Although with FIG. 6-FIG. 10 cases are explained on the premise that each excitation vector is assigned 4 types of additional dispersion vectors, the present invention is by no means limited to this. For instance, the number (type) of additional dispersion vectors shown in FIG. 6-FIG. 10 can be one.

Moreover, although no drawing shows such, when there are 3 pulses, each excitation vector having a specific shape of high frequency of use is provided with a unique additional dispersion vector.

Figure 12:
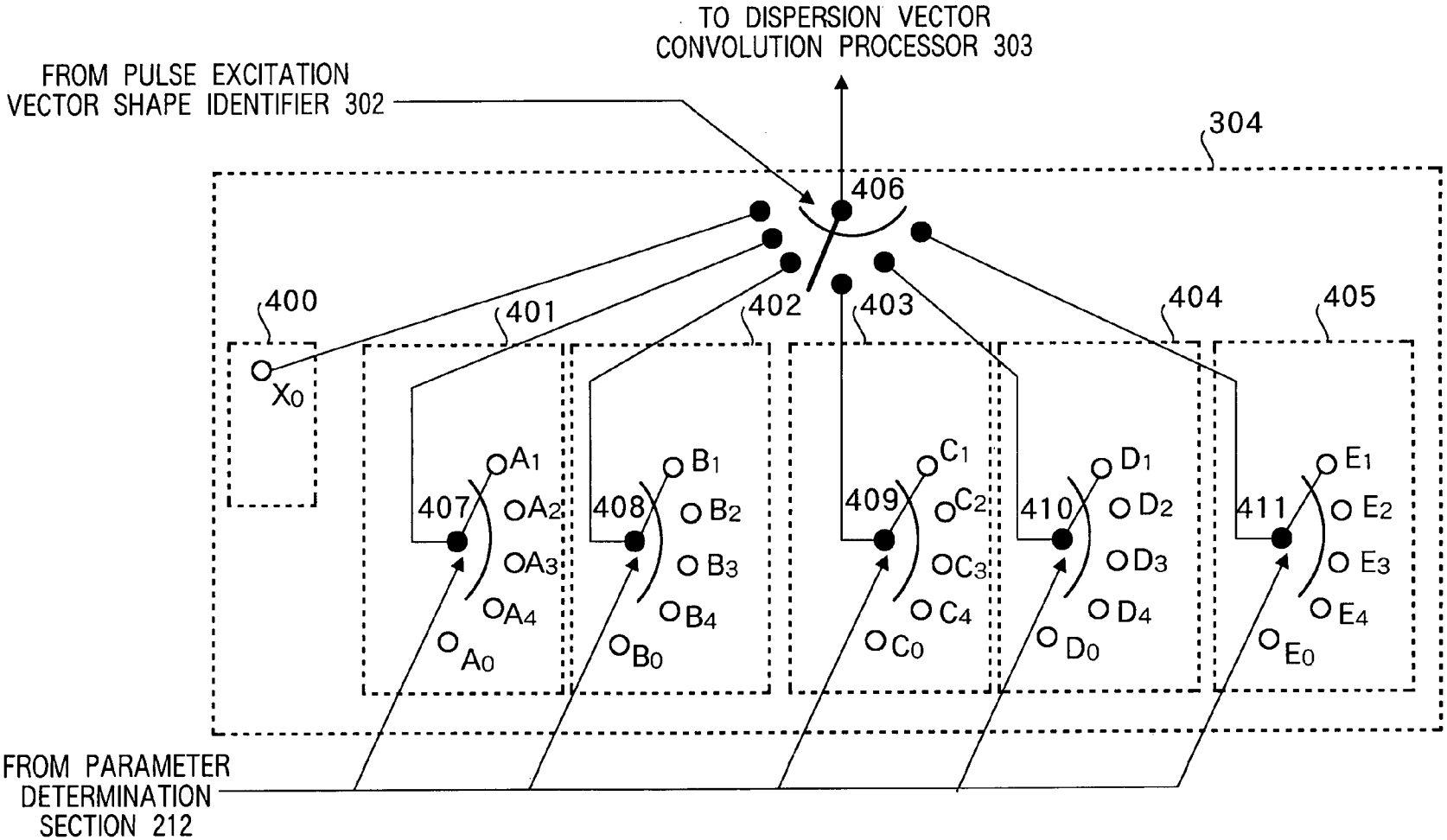
FIG. 12 is a drawing describing the detail of selection processing in a dispersion vector storage according to the first embodiment of the present invention.

FIG. 12 is a drawing showing the content of selection processing in dispersion vector storage 304 where additional dispersion vectors are provided as shown in FIG. 6-FIG. 10.

As shown in FIG. 12, dispersion vector storage 304 comprises a plurality of dispersion vector subsets 400-405.

Dispersion vector subset 400, comprising terminal X0 that outputs a fundamental dispersion vector, outputs the fundamental dispersion vector to dispersion vector convolution processor 303 via switch 406.

Dispersion vector subset 401, comprising terminals A1-A4 that output the four additional dispersion vectors shown in FIG. 6 and terminal A0 that outputs the fundamental dispersion vector, selects one dispersion vector determined by parameter determination section 212 from among 5 types of dispersion vectors A0-A4 by means of switch 407 and outputs this to dispersion vector convolution processor 303 via switch 406.

Similarly, dispersion vector subsets 402-405, comprising terminals B1-B4, C1-C4, D1-D4, and E1-E4 that output the four additional dispersion vectors shown in FIG. 7-FIG. 10, and terminals B0, C0, D0, and E0 that output the fundamental dispersion vector, respectively, select one dispersion vector determined in parameter determination section 212 by means of switches 408, 409, 410, 411, and output them to dispersion vector convolution processor 303 via switch 406.

In FIG. 12, the fundamental vectors output from terminals X0, A0, B0, C0, D0, and E0 are identical.

Switch 406, which performs the switching of dispersion vector subsets 400-405, switches in accordance with the shape of pulse excitation vectors output from pulse excitation codebook 301 and based on control of pulse excitation vector shape identifier 302. That is, when a pulse excitation vector of a specific shape of high frequency of use is input from pulse excitation codebook 301 into pulse excitation vector shape identifier 302, switch 406 is connected to dispersion vector subsets 401-405 corresponding to pulse excitation vectors of that shape. When a pulse excitation vector of a non-specific shape is input from pulse excitation codebook 301 into pulse excitation vector shape identifier 302, switch 406 is connected to an output terminal of dispersion vector subset 400.

Switches 407-411 connect with terminals in dispersion vector subsets 401-405 that output dispersion vectors determined in parameter determination section 212 from among 5 types of dispersion vectors.

According to the above configuration, when a excitation vector that is identical to one memorized in pulse excitation vector shape identifier 302 is output from pulse excitation codebook 301, the optimum one is selected from among 5 types including 4 types of additional dispersion vectors and a fundamental dispersion vector.

Referring to FIG. 12, although there are 5 dispersion vector subsets provided with additional dispersion vectors, the number of dispersion vector subsets is by no means limited by the present invention and can be increased or decreased depending on the number of pulse excitation vector patterns with high frequency of use. Similarly, although each dispersion vector subset is provided with 4 types of additional dispersion vectors, the present invention sets no limit on the number of additional dispersion vectors.

Figure 13:
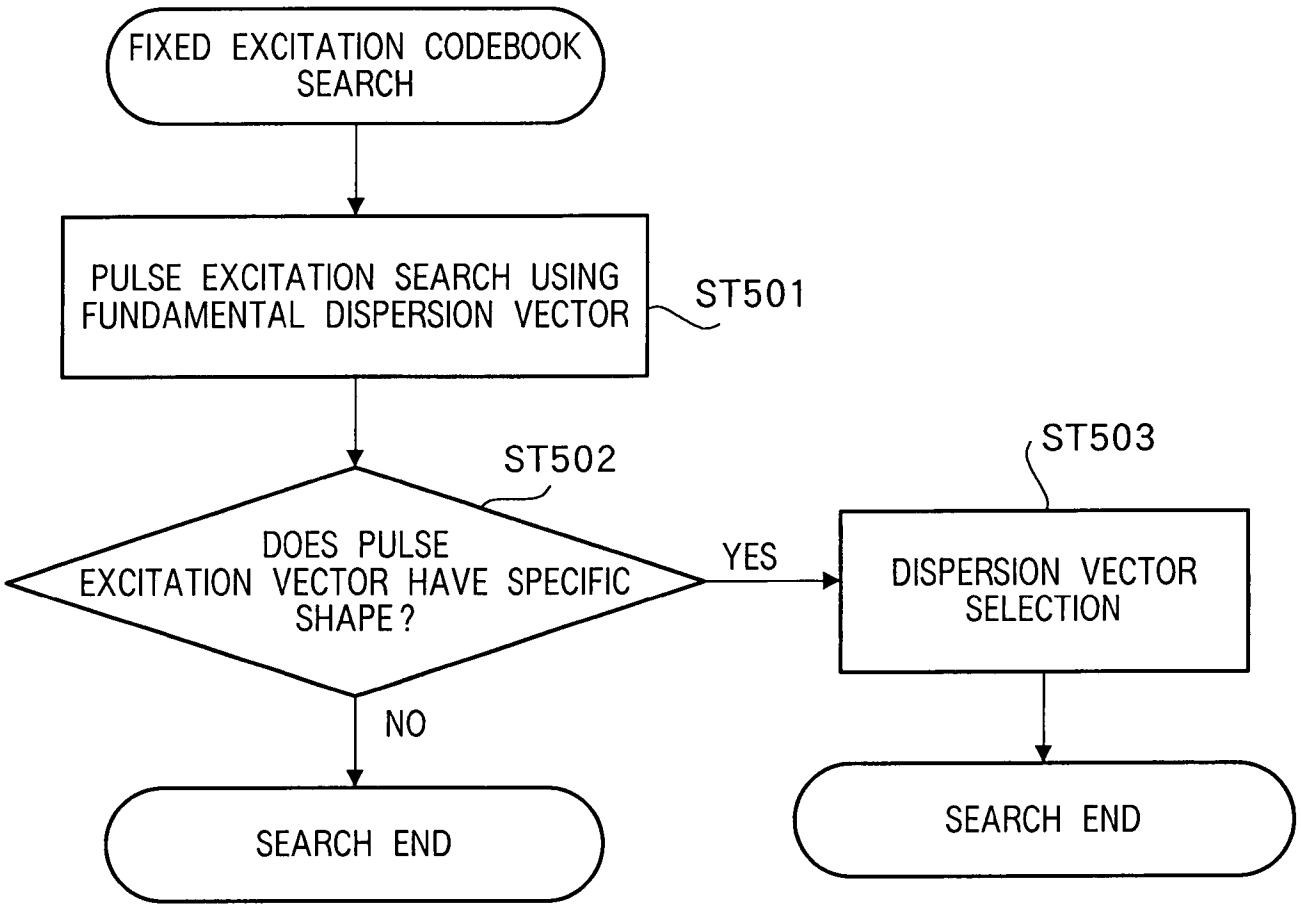
FIG. 13 is a flowchart showing the steps of processing in a fixed excitation codebook according to the first embodiment of the present embodiment.

FIG. 13 shows the steps of important parts of the above described processing. FIG. 13 is a flowchart showing the processing flow of a fixed excitation codebook search in FIG. 4.

First, in ST501, a pulse excitation search is performed using a fundamental dispersion vector. An impulse may be used for the fundamental dispersion vector (that is, no dispersion). A specific search method is disclosed, for instance, in Laid-Open Japanese Patent Application Publication No. HEI10-63300 (the 17th paragraph ("Background Art") and the 51st through 54th paragraphs), and in the part of 2.2 in K.Yasunaga et. al, "Dispersed-pulse codebook and its application to 4 kb/s speech coder," Proc. ICASSP2000, pp.1503-1506, 2000.

Next, in ST502, whether the pulse excitation vector selected in ST501 has parameters (pulse positions and combination of signs) for a predetermined specific shape is checked.

These specific shapes refer to the shapes of those vectors, among pulse excitation vectors generated from the pulse excitation codebook, that are frequently used as a fixed excitation vector (selected as a result of search).

That is, to be more specific, for instance, among 2-pulse excitations, vectors of high frequency of use refer to those that have the shape in which the distance between pulses is 1 (for instance, excitation pulses occur in the 11th sample and in the 12th sample) and the pulse polarities have different polarities and the shape in which the distance between pulses is 2 samples (for instance, an excitation pulse occurs in the 20th sample and in the 22nd sample) and the pulse polarities have the same code.

When excitation vectors do not have these specific shapes, a pulse excitation vector selected in ST501 is convoluted with a fundamental dispersion vector and used as a fixed excitation vector.

That is, switch 406 of FIG. 12 is connected to terminal X0 of dispersion vector subset 400. If the pulse excitation vector selected in ST501 has a specific shape, ST503 follows.

ST503 checks whether there are dispersion vectors, among the additional dispersion vectors of dispersion vector subsets (dispersion vector subsets 401-405 of FIG. 12) provided dedicated to vectors of specific shapes, that make quantization error less than the fundamental dispersion vector, and selects the dispersion vector that minimizes quantization error the most from the fundamental dispersion vector and the additional dispersion vectors. A pulse excitation vector shape identifier 302 selects appropriate dispersion vector subset containing the additional dispersion vectors.

The result of convoluting the pulse excitation vector selected in ST501 and the dispersion vector selected in ST502 or in ST503 is determined as a fixed excitation code vector.

Such configuration, in which a number of dedicated additional dispersion vectors are provided only for pulse excitation vectors having specific shapes of high frequency of use, minimizes increase in the amount of information and is more readily implementable, and there may be cases where a pulse excitation codebook (when the pulse excitation codebook has codes that are not used) is implemented without increase in the number of bits.

Now, the encoding and decoding of a fixed excitation codebook generated by the above method will be explained with a specific example. For example, a case will be described here where there are 2 pulses in 80 samples. Each pulse can occur in any 1 sample of the 80 samples. The two pulses, referred to as pulse 1 and pulse 2, may even occur in 1 sample in an overlap. The pulse amplitude in this case is the amplitude of pulse 1 and pulse 2 added, and if each pulse has the amplitude of 1, this will be one pulse with the amplitude of 2. When the 2 pulses occur in different samples, their combinations will be 80C2=3160 patterns. The polarity relationship of the two pulses are in 2 patterns of homopolarity and heteropolarity, and so the shape of a pulse excitation vector has 3160×2=6320 patterns. The 80 patterns of the case where two pulses overlap and become one are added thereto, and so there are total 6400 patterns for the shape of a pulse excitation vector. Finally, the polarity of the pulse excitation vector as a whole has two patterns, and so there are 6400×2=12800 patterns (<14 bits) Then, by representing the polarity of pulse 1 by one bit, such that when pulse 1 is behind pulse 2 the 2 pulses are heteropolar and when pulse 1 and pulse 2 are at the same position or pulse 2 is ahead the 2 pulses are homopolar, it is possible to express 12800 patterns of vectors with 14 bits.

Now, the method of representing the above fixed codebook in 14-bit codes will be explained.

First, a pulse excitation search is performed, and the position and sign of pulse 1 and pulse 2 are determined. Next, the spatial relationship between pulse 1 and pulse 2 is checked. Now, if pulse 2 is behind pulse 1, whether the polarity relationship between pulse 1 and pulse 2 is heteropolar is checked, and if it is not heteropolar, the positions of pulse 1 and pulse 2 are swapped. On the other hand, when pulse 1 and pulse 2 are at the same position or pulse 2 is ahead, whether the polarity relationship between pulse 1 and pulse 2 is homopolar is checked, and, when it is not homopolar, the positions of pulse 1 and pulse 2 are swapped.

Pulse 1 and pulse 2 determined thus are encoded as follows. Assume that the 14 bits include 0-13 (bit 0 being the lowest bit). Bit 13 (=S), which is the highest bit, is the one bit that represents the sign of pulse 1, which is 1 when positive and 0 when negative.

Next, the combination of the positions of the 2 pulses will be encoded. For example, assuming that the position of pulse 1 is p1 and the position of pulse 2 is p2, code CF is encoded: CF=p1×80+p2. Acquired thus, CF is 0-6399, represented with 13 bits of 0-12 (0-8191). As a result, it is possible to assign fixed code vectors, to which additional dispersion vectors are applied, to the remaining 6400-8191.

If 5 types of shapes of pulse excitation vectors in which:

(1) Distance between pulse 1 and pulse 2 is 2 samples, homopolar (78 patterns);

(2) Distance between pulse 1 and pulse 2 is 1 sample, homopolar (79 patterns);

(3) Distance between pulse 1 and pulse 2 is 0 sample, homopolar (80 patterns);

(4) Distance between pulse 1 and pulse 2 is 1 sample, heteropolar (79 patterns); and (5) Distance between pulse 1 and pulse 2 is 2 samples, heteropolar (78 patterns), are each assigned 4 types of additional dispersion vectors, (1) is 78×4=312 and can be assigned codes 6400-6711; (2) is 79×4=316 and can be assigned codes 6712-7027; (3) is 80×4=320 and can be assigned codes 7028-7347; (4) is 79×4=316 and can be assigned codes 7348-7663; and (5) is 78×4=312 and can be assigned codes 7664-7975. To be specific, if the number of additional dispersion vectors selected by search processing is dv(=0-3), code CF is generated when a pulse excitation vector shape determiner determines on:

$$CF=6400+78\times dV+(p1-2),\ (2\leqq p1\leqq 79); \quad (1)$$

$$CF=6712+79\times dV+(p1-1),\ (1\leqq p1\leqq 79); \quad (2)$$

$$CF=7028+80\times dV+(p1),\ (0\leqq p1\leqq 79); \quad (3)$$

$$CF=7348+79\times dV+(p1),\ (0\leqq p1\leqq 78);\ \text{and} \quad (4)$$

$$CF=7644+78\times dV+(p1),\ (0\leqq p1\leqq 77). \quad (5)$$

Finally the sign bit is attached to the top, and thus transmission code F is generated (F=S×8192+CF)

The position p1 and sign s1 of pulse 1, the position p2 and sign s2 of pulse 2, and applicable dispersion vector information are encoded.

Next, the decoding by a decoder that received transmission code F will be explained. In the decoder, two pulse positions (p1, p2) and the signs (s1, s2) are decided in the following steps.

First, sign information S is decoded from received code F.

$$S=((F>>13\&1)\times 2-1 \text{ (S becomes } -1 \text{ or } +1)$$

Next, pulse position information code CF is decoded.

$$CF=F\&0\times 1FFF$$

Next, depending on the value of CF, the processing will switch as follows:

(1) CF is less than 6400

$$p2=CF\ \%\ 80,\ p1=(CF-p2)\div 80$$

$$s1=S,\ s2=-S(\text{where } p2>p1),=+S(\text{where } p2\leqq p1)$$

For the dispersion vector, the fundamental dispersion vector is used.

(2) CF is greater than or equal to 6400 and less than 6712

$$p1=(CF-6400)\%\ 78+2,\ p2=p1-2,\ s1=s2=S$$

The dvth additional dispersion vector of subset 1 (FIG. 6) is used.

$$dv=((CF-6400)-(p1-2))\div 78$$

(3) CF is greater than or equal to 6712 and less than 7028

$$p1=(CF-6712)\%\ 79+1,\ p2=p1-1,\ s1=s2=S$$

The dvth additional dispersion vector of subset 2 (FIG. 7) is used.

$$dv=((CF-6712)-(p1-1))\div 79$$

(4) CF is greater than or equal to 7028 and less than 7348

$$p1=(CF-7028)\%\ 80,\ p2=p1,\ s1=s2=S$$

The dvth additional dispersion vector of subset 3 (FIG. 8) is used.

$$dv=((CF-7028)-p1)\div 80$$

(5) CF is greater than or equal to 7348 and less than 7664

$$p1=(CF-7348)\%\ 79,\ p2=p1+1,\ s1=S,\ s2=-S$$

The dvth additional dispersion vector of subset 4 (FIG. 9) is used.

$$dv=((CF-7348)-p1)\div 79$$

(6) CF is greater than or equal to 7664 and less than 7975

$$p1=(CF-7664)\%\ 78,\ p2=p1+2,\ s1=S,\ s2=-S$$

The dvth additional dispersion vector of subset 5 (FIG. 10) is used.

$$dv=((CF-7664)-p1)\div 78$$

The position p1 and sign s1 of pulse 1, the position p2 and signs 2 of pulse 2, and applicable dispersion vector information are decoded as above.

Figure 14:
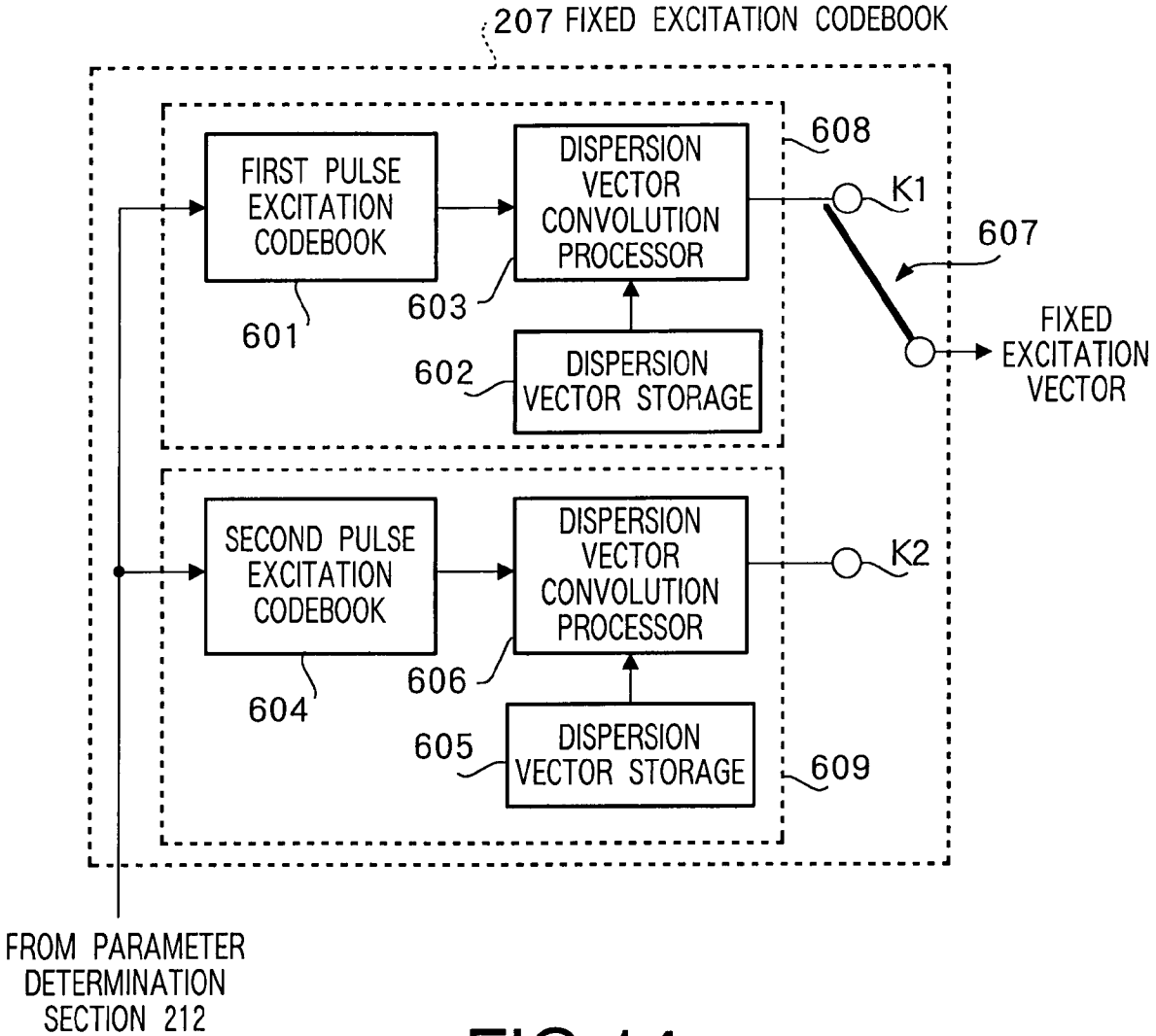
FIG. 14 is a block diagram showing another configuration of a fixed excitation codebook according to the first embodiment of the present invention.

FIG. 14 is a block diagram showing another configuration of a fixed source codebook.

Fixed excitation codebook 207 of FIG. 14 comprises two fixed excitation codebook subsets 608 and 609. First fixed excitation codebook subset 608 comprises three blocks, namely first pulse excitation codebook 601, dispersion vector storage 602, and dispersion vector convolution processor 603. First pulse excitation codebook 601 is an excitation codebook that generates predetermined pulse excitation vectors (for example, vectors composed of two pulses). Dispersion vector storage 602 is a storage that stores the dispersion vectors designed dedicated to first pulse excitation codebook 601. Dispersion vector convolution processor 603 is a convolution processor that convolutes a dispersion vector output from dispersion vector storage 602 in a pulse excitation vector output from first pulse excitation codebook 601.

Similarly, second fixed excitation codebook subset 609 comprises three blocks, namely second pulse excitation codebook 604 (for instance, second pulse excitation codebook 604 is different from first pulse excitation codebook 601, and generates pulse excitation vectors composed of 3 or 5 pulses), dispersion vector storage 605, and dispersion vector convolution processor 606.

Now, the dispersion vector storages inside the fixed source codebook subsets are designed respectively dedicated to the pulse excitation codebooks of the subsets.

Although a case was described with the present embodiment where the number of subsets in a fixed excitation codebook is 2, the present invention sets no limit on the number, and even when the number is 3 or more, the same effect can still be achieved.

Moreover, the pulse excitation codebooks in the respective subsets may be different in the number of excitation pulses included in an excitation vector or in the patterns of excitation pulses (for example, one excitation pulse codebook generates only the combinations of close-positioned pulses, while the other excitation pulse codebook generates the combinations of separate-positioned pulses).

In any way, generating excitation vectors of different features and characteristics on a per subset basis heightens the degree of performance improvement. Switch 607 selects one of the fixed excitation vectors output from dispersion vector convolution processor 603 and from dispersion vector convolution processor 606.

This fixed source codebook generates a fixed excitation vector specified by signal (F) input from parameter determination section 212 by means of first fixed excitation codebook subset 608 or second fixed excitation codebook subset 609, and outputs the result as a fixed excitation vector via switch 607.

Figure 15:
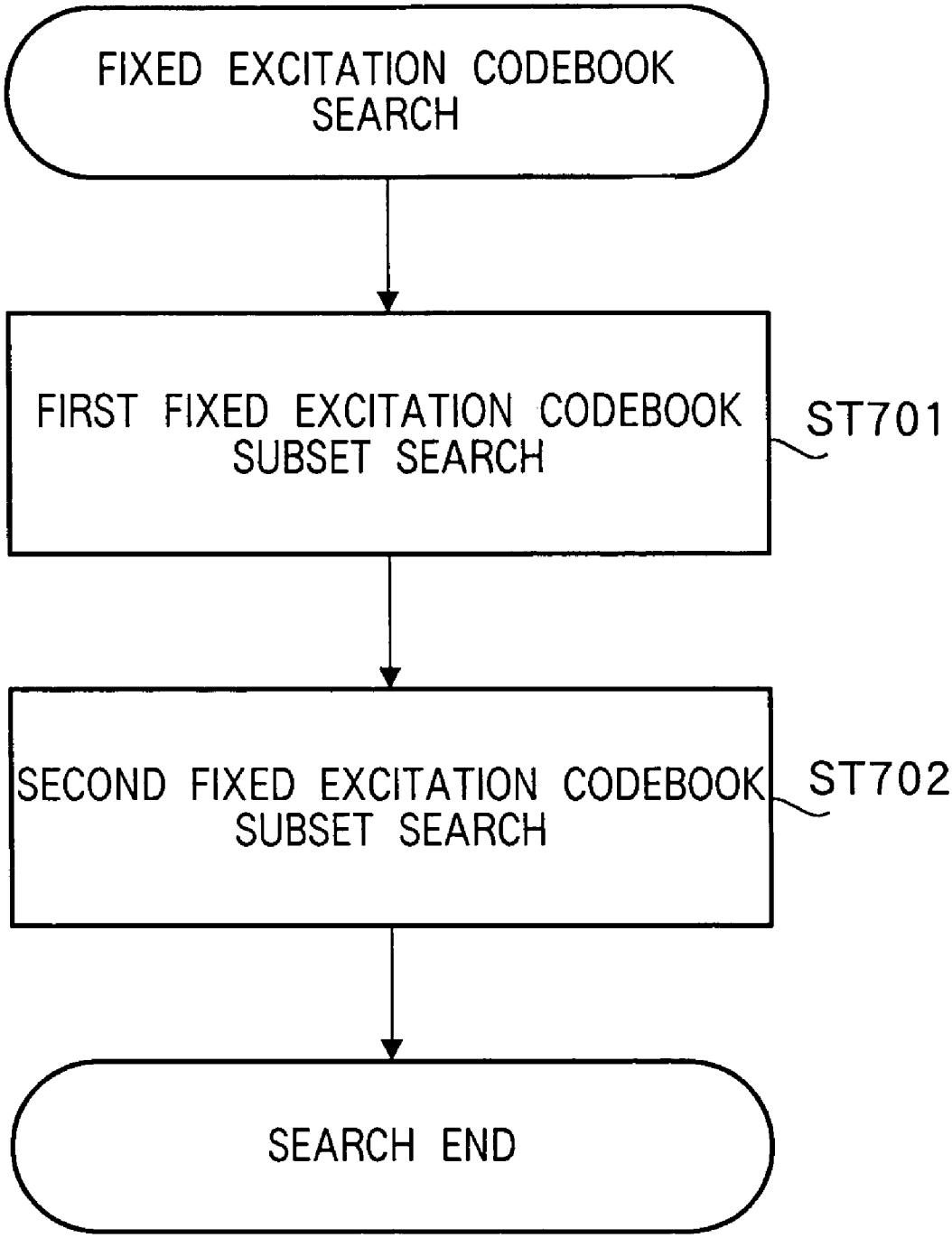
FIG. 15 is a block diagram showing the steps of processing for searching a fixed excitation codebook according to the first embodiment of the present invention.

FIG. 15 is a flowchart showing the processing steps of searching the fixed excitation codebook of FIG. 14.

First, in ST701, the first fixed codebook subset is searched, and a fixed excitation vector that minimizes quantization error is selected.

Next, in ST702, the second fixed codebook subset is searched, and, if there is a fixed excitation vector that minimizes quantization error more than the fixed excitation vector selected in ST701, this is selected as the final fixed excitation vector.

ST701 and ST702 are different only in that different dispersion vectors are applied to different fixed codebooks. The different fixed excitation codebooks are provided such that excitation code vectors generated respectively have different characteristics (different numbers of source pulses, for instance).

The fixed excitation codebook subsets may be provided with different numbers of excitation pulses, such that the first fixed excitation codebook subset generates excitation vectors composed of two excitation pulses and the second fixed excitation codebook subset generates fixed excitation vectors composed of five excitation pulses. Moreover, fixed excitation codebook subsets of different combinations of excitation pulses may be provided, such that the first fixed codebook subset generates fixed excitation vectors of combinations of close-positioned pulses and the second fixed excitation codebook subset generates fixed excitation vectors in which a number of excitation pulses are diffused and placed over the whole vector (for example, even though the first fixed excitation codebook subset and the second fixed excitation codebook subset generate excitation vectors composed of the same number of pulses, the first fixed excitation codebook subset generates fixed excitation codebook vectors in which all pulses are placed within the range of a predetermined number of samples, M (for instance, 2-10 samples), while the second fixed excitation codebook subset generates fixed excitation vectors in which the intervals of all excitation pulses are above a predetermined number of samples, M' (for instance, 10 samples).

As described above, by applying dedicated dispersion vectors to excitation vectors of specific shapes of high frequency of use, it is possible to effectively improve the quality of decoded speech. Moreover, by applying different dispersion vectors depending on the characteristics of pulse excitation vectors, it is possible to effectively improve the quality of decoded speech.

Incidentally, as long as the configuration is such that a number of dedicated dispersion vectors are provided only for pulse excitation vectors of specific shapes with high frequency of use, increase or decrease in the number of dispersion vector patterns is of minor significance, and likewise the trouble of designing dispersion vector patterns is of minor significance.

On the other hand, the quality of decoded speech can be improved very effectively and efficiently. That is, providing many dispersion vectors that contribute little to actual sound quality improvement is meaningless processing, and yet according to the present invention, by adding a small number of dedicated dispersion patterns (additional dispersion vectors), it is possible to efficiently achieve the effect of improving sound quality.

The above described fixed excitation codebook can be implemented by means of hardware, and it is also possible to store necessary vector data in database and, using this data, generate waveform data of fixed excitation vectors by means of software.

Second Embodiment

A digital filter with high-frequency emphasis function is conventionally provided in a part after a synthesis filter where signal processing is performed, and, generally, this filter is a high-pass filter represented by means of a one-dimensional digital filter, which is disclosed, for example, in J-H. Chen and A. Gersho, "Adaptive Postfiltering for Quality Enhancement of Coded Speech", IEEE Trans. Speech & Audio Processing, Vol. 3, No. 1, January 1995.

In contrast, the present embodiment is characterized in that, at the speech decoding end, unique high-frequency emphasis processing is applied to signals before a synthesis filter.

Figure 16:
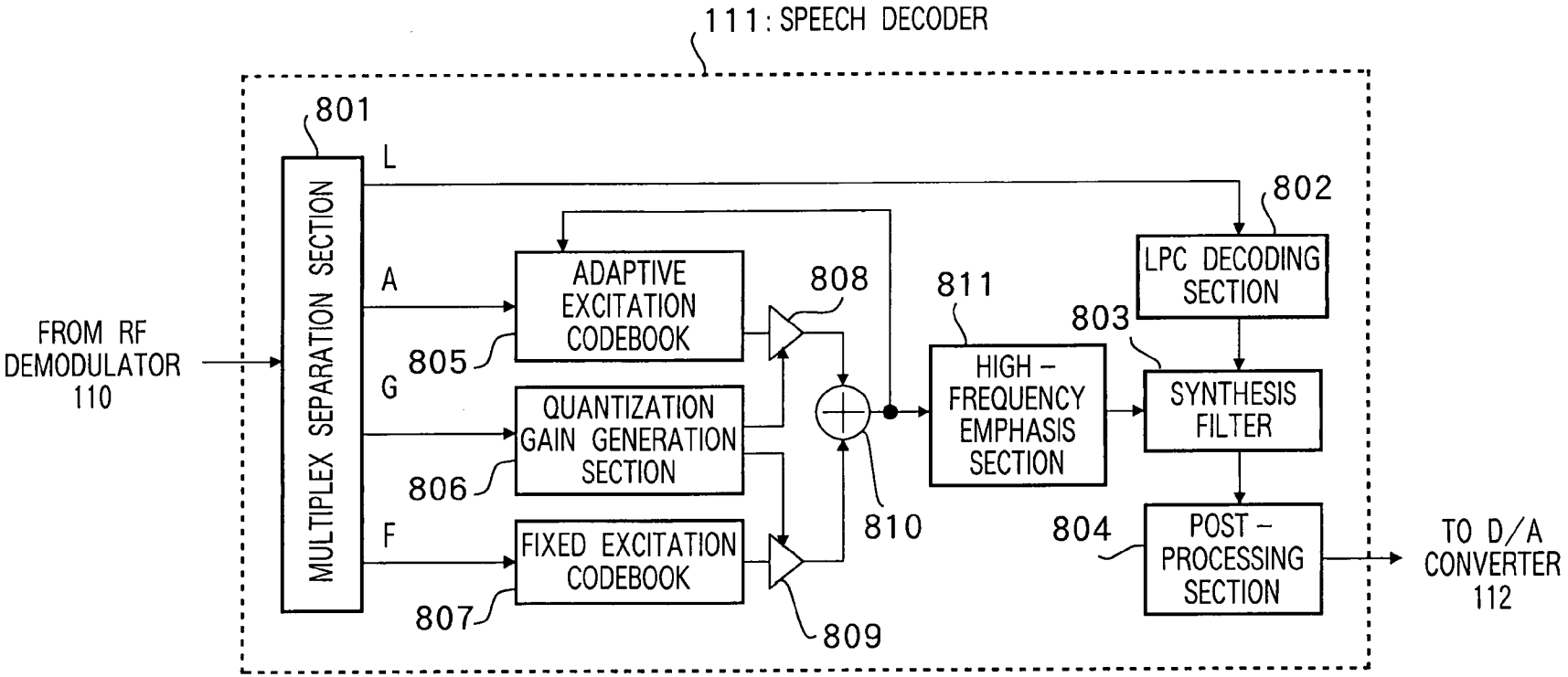
FIG. 16 is a block diagram showing a configuration of a speech decoder according to the second embodiment of the present invention.

FIG. 16 is a block diagram showing a configuration of speech decoder 111 of FIG. 2.

Referring to FIG. 16, multiplex separation section 801 separates coded information output from RF demodulator 110, which is multiplex coded information, into individual code information. Separated LPC code (L) is output to LPC decoding section 802, separated adaptive excitation vector code (A) is output to adaptive excitation codebook 805, separated excitation gain code (G) is output to quantization gain generation section 806, and separated fixed excitation vector code (F) is output to fixed excitation codebook 807.

LPC decoding section 802 decodes an LPC from code (L) output from multiplex separation section 801, and outputs it to synthesis filter 803. Adaptive excitation codebook 805 takes one frame of samples as an adaptive excitation vector from the past drive excitation signal samples specified by code (A) output from multiplex separation section 801, and outputs it to multiplier 808.

Quantization gain generation section 806 decodes an adaptive excitation vector gain and a fixed excitation vector gain specified by excitation gain code (G) output from multiplex separation section 801, and output them to multiplier 808 and multiplier 809.

Fixed excitation codebook 807, generates a fixed excitation vector specified by code (F) output from multiplex separation section 801, and outputs it to multiplier 809.

Multiplier 808 multiplies the adaptive excitation vector by the above adaptive excitation vector gain, and outputs the result to adder 810. Multiplier 809 multiplies the fixed excitation vector by the fixed excitation vector gain, and outputs the result to adder 810.

Adder 810 performs addition of the adaptive excitation vector and the fixed excitation vector output from multipliers 808 and 809 after gain multiplication, generates a drive excitation vector, and outputs it to high-frequency emphasis section 811.

High-frequency emphasis section 811 (high-frequency emphasis postfilter) applies unique high-frequency emphasis processing to the drive excitation vector (for example, high-frequency emphasis processing is performed such that the degree of amplitude emphasis is higher for components of higher frequency) and outputs the signal after high-frequency emphasis to synthesis filter 803. The detail of high-frequency emphasis section 811 will be explained later.

Synthesis filter 803 performs filter synthesis of the excitation vector output from high-frequency emphasis section 811 as a drive signal using a filter coefficient decoded by LPC decoding section 802, and outputs the reconstructed signal to post-processing section 804.

Post-processing section 804 performs processings such as formant emphasis and pitch emphasis that improve the subjective quality of speech, and processings that improve the subjective quality of environmental noise, and thereafter outputs the final decoded speech signal to D/A converter 112.

Next, high-frequency emphasis processing will be described in detail with reference to FIG. 17.

Generally, in CELP encoding, a high component of a decoded signal tends to weaken. This tendency intensifies especially at low bit rates, and so by emphasizing the high component of a decoded signal, it is possible to improve the subjective quality to a certain degree.

Figure 17:
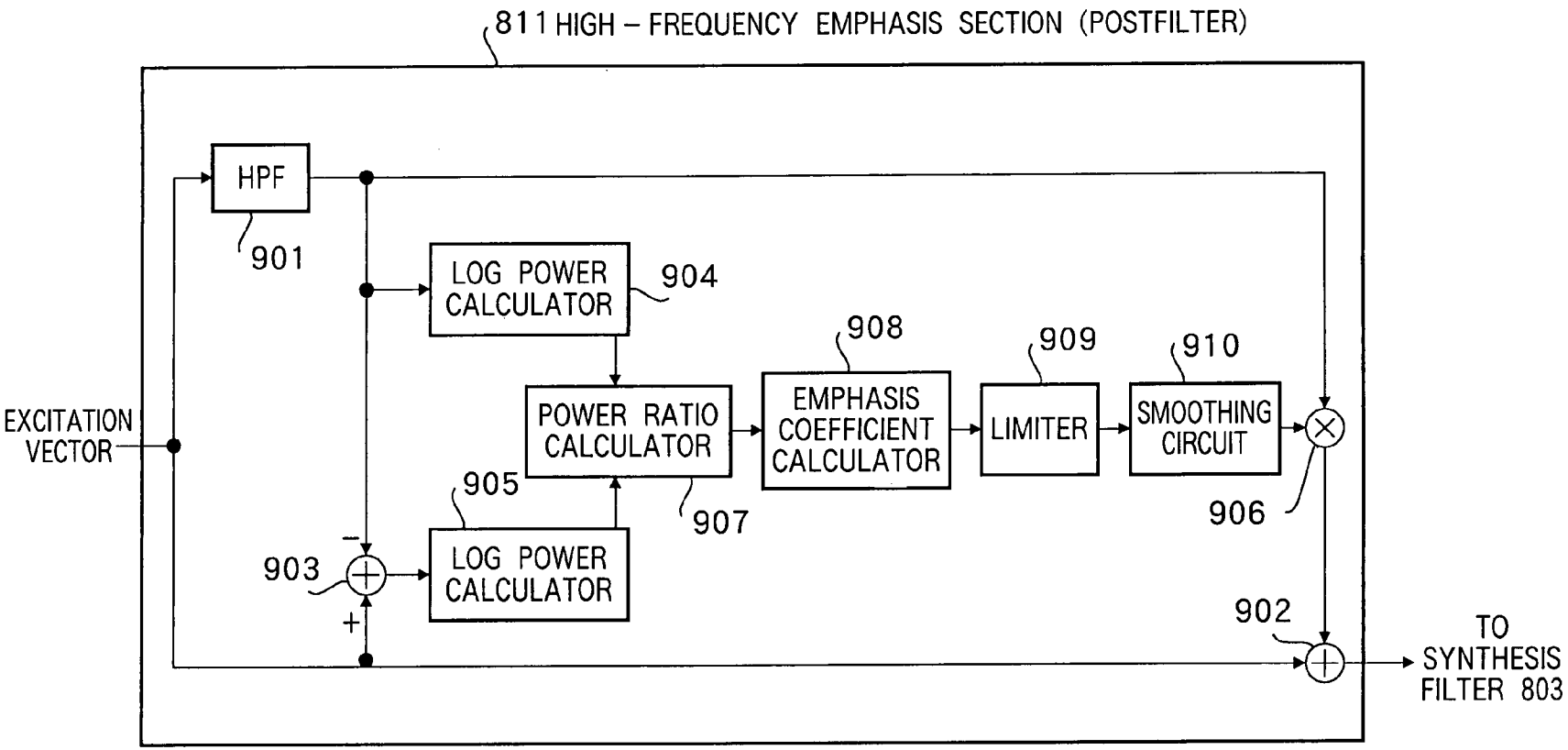
FIG. 17 is a block diagram showing a configuration of a high-range amplifying section according to the second embodiment of the present invention.

In high-frequency emphasis section 811 (high-frequency emphasis postfilter) of FIG. 17, an excitation vector is input to high-pass filter 901 (HPF) adder 902, and adder 903.

High-pass filter 901 does the job of extracting a high-frequency component that needs to be amplified. A component of a drive excitation vector corresponding to higher frequency than the cutoff frequency of high-pass filter 901 is output to adder 903, log power calculator 904, and multiplier 906.

Adder 903 subtracts the high component of the excitation vector from the excitation vector, and outputs the result to log power calculator 905.

Log power calculator 904 calculates the log power of the high component of the excitation vector and outputs the result to power ratio calculator 907. Log power calculator 905 calculates the log power of the signal, which is the excitation vector minus the high component, and outputs the result to power ratio calculator 907.

Power ratio calculator 907 calculates the log power ratio between the high component and the other components of the excitation vector, and outputs the result to emphasis coefficient calculator 908.

Emphasis coefficient calculator 908 calculates the coefficient (emphasis coefficient Rr) to multiply the high component of the excitation vector by, such that the log power ratio becomes basically constant.

To be more specific, where a signal output from log power calculator 904 is Eh[i], a signal output from log power calculator 905 is El[i], and L indicates the subframe length, log power ratio R output from log power calculator 905 can be expressed by the following equation:

$$R=\log 10(\Sigma El[i])-\log 10(\Sigma Eh[i])(i=0, 1, \ldots L-1) \quad (1)$$

Then, to make this log power ratio R at constant value Cr (0.42, for instance), emphasis coefficient calculator 908 obtains coefficient Rr as the ratio between Cr and R (log power ratio) by the following equation (2):

$$Rr=R-Cr \quad (2)$$

Limiter 909 sets a lower limit value (for instance, 0)and an upper limit value (for instance, 0.3) of coefficient Rr, making coefficient Rr the upper limit value when the value of coefficient Rr calculated by emphasis coefficient calculator 908 is larger than the upper limit value, and making coefficient Rr the lower limit value when the value of coefficient Rr is less than the lower limit value.

Smoothing circuit 910 smoothes the values of emphasis coefficient Rr with time (between samples and/or between subframes) such that the value of emphasis coefficient Rr changes smoothly between subframes and between samples.

To be more specific, first, as indicated by the following equation (3), the log power ratio is converted to a linear domain and subtracted by 1. This is to add only the portion above 1.0 to the original source signal (from 810) from which the high component is not subtracted.

$$Rrl=pow(10., Rr)-1 \quad (3)$$

Then, smoothing is performed such that Rrl changes smoothly between (sub) frames. The smoothing coefficient $\alpha$ is set so as not to make the smoothing excessively strong (for instance, $\alpha$=0.3)

$$Rrl'=\alpha\times Rrl'+(1-\alpha)\times Rrl \quad (4)$$

Moreover, when this emphasis coefficient Rrl' after smoothing is multiplied by output signal exh[i] from high-pass filter 901 and added to excitation vector ex[i], by the following equation (5), Rrl' is smoothed on a per sample basis and made Rrl". This smoothing processing is relatively strong (for instance, $\beta$=0.9)

```
for(i=0;i<L;i++) {
Rrl"=β×Rrl" + (1−β)×Rrl';
exn[i]=ex[i]+Rrl"×exh[i];
}
```

Multiplier 906 multiplies high component exh[i] of the excitation vector output from high-pass filter 901 by emphasis coefficient Rrl" smoothed in smoothing circuit 910.

Adder 902 adds high component signal Rrl"×exh[i] multiplied by the smoothed coefficient to excitation vector exn[i], and outputs the result to synthesis filter 803.

Above exn[i] can be directly output to synthesis filter 803, and yet it is more common to perform scaling processing so as to give the same power as original excitation vector ex[i]. Such scaling processing may be performed after adder 902, or above Rrl" maybe calculated in consideration of scaling processing. In the latter case, an input line from high-pass filter 901 to smoothing circuit 910 is necessary. In the former case, a scaling processing section enters between adder 902 and synthesis filter 803, and an excitation vector (from adder 810) and the excitation vector after high-frequency emphasis (from adder 902) is input into the scaling processing section.

The processing in detail is as follows:

```
(when performed after adder 902)
Ene__ex =Σ(ex[i]×ex[i])          (i=0,1,...L−1)
Ene__exn=Σ(exn[i]×exn[i])
Scl=√(Ene__ex/Ene__exn)
for(i=0;i<L;i++){
        Scl'=β×Scl' + (1−β)×Scl;
        exn[i]=exn[i]×Scl';
}
(when scaling processing is included in Rrl")
Ene__ex =Σ(ex[i]×ex[i]),          (i=0,1,...L−1)
Ene__exn = Σ((Rrl'×exh[i] + ex[i])×(Rrl'×exh[i] +
ex[i]))
Scl=√(Ene__ex/Ene__exn)
for(i=0;i<L;i++){
        Rrl"=β×Rrl" + (1−β)×Scl;
        exn[i]=Rrl"×(Rrl'×exh[i]+ex[i]);
}
```

The characteristics of high-pass filter 901 are adjusted so as to optimize the subjective quality of decoded speech signals. To be more specific, a two-dimensional IIR filter that makes the cutoff frequency approximately 3 kHz when the sampling frequency is 8 kHz is preferable. In addition, according to the present embodiment, the cutoff frequency can be designed freely so as to be suitable for the speech signal encoding characteristics of the encoder. Moreover, the degree for the above high-pass filter can be designed freely as well so as to have the desired filter characteristics and to meet a requirement of the amount of computation that can be tolerated.

By thus performing high-frequency emphasis processing by means of a digital filter with unique transfer function, it is possible to compensate gain reduction of an excitation signal in high-frequency ranges and implement flat characteristics, so that unique filter characteristics effective for auditory enhancement can be implemented, thereby enabling effective improvement of the quality of decoded speech. For instance, by performing high-frequency emphasis, it is possible to prevent decoded speech from gaining a muffled subjective quality.

Moreover, the high-frequency emphasis postfilter can be readily provided before a synthesis filter, and the present invention can be readily applied to actual products.

As described above, the present invention enables efficient enhancement of the quality of decoded speech by adding minimum hardware. The present invention also enables performance improvement of a fixed excitation codebook that has pulse dispersion configurations. Moreover, it is possible to effectively compensate the high attenuation of excitation vectors in CELP encoding and improve the subjective quality.

The fixed vector generation method, CELP type speech encoding method, and the CELP type speech decoding method of the present invention can be implemented by installing a program through communication channels or from a CD or other memory mediums and executing it by means of controlling means such as CPU.

The present application is based on Japanese Patent Application No.2002-043878, filed on Feb. 20, 2002, entire content of which is expressly incorporated herein by reference.

INDUSTRIAL APPLICABILITY

The present invention is suitable for use in a CELP type speech encoder or a CELP type speech decoder.

The invention claimed is:

1. A CELP type speech decoder that receives an excitation gain code, an adaptive excitation vector code, and a fixed excitation vector code associated with encoded speech transmitted from a CELP type speech encoder and decodes the encoded speech, said CELP type speech decoder comprising:

a quantized gain generating section that receives the excitation gain code from the CELP type speech encoder and decodes an adaptive excitation vector gain and a fixed excitation vector gain specified by the excitation gain code;

an adaptive excitation codebook that receives the adaptive excitation vector code from the CELP type speech encoder and takes one frame of samples as an adaptive excitation vector from past excitation signal samples specified by the adaptive excitation vector code;

a fixed excitation codebook that receives the fixed excitation vector code from the CELP type speech encoder and generates a fixed excitation vector specified by the fixed excitation vector code;

an excitation vector generating section that generates an excitation vector by adding a vector obtained by multiplying the adaptive excitation vector gain and the adaptive excitation vector, and a vector obtained by multiplying the fixed excitation vector gain and the fixed excitation vector;

a high-frequency emphasis section that performs high-frequency emphasis processing on the excitation vector generated by the excitation vector generating section; and a synthesis filter that performs filter synthesis of the excitation vector output from the high-frequency emphasis section employing a set of filter coefficients to output decoded speech data, wherein said fixed excitation codebook comprises:

a comparing section that compares the shape of a pulse excitation vector with predetermined shapes to determine a predetermined shape which matches the shape of said pulse excitation vector;

a storing section that stores sets of dispersion vectors that are designed exclusively for each of said predetermined shapes;

a selecting section that selects a set of said dispersion vectors that are associated with the predetermined shape which matches the shape of said pulse excitation vector; and a convolving section that convolves said pulse excitation vector with one of the dispersion vectors in the selected set to obtain the fixed excitation vector.

2. A CELP type speech decoder that receives an excitation gain code, an adaptive excitation vector code, and a fixed excitation vector code associated with encoded speech transmitted from a CELP type speech encoder and decodes the encoded speech, said CELP type speech decoder comprising:

a quantized gain generating section that receives the excitation gain code from the CELP type speech encoder and decodes an adaptive excitation vector gain and a fixed excitation vector gain specified by the excitation gain code;

an adaptive excitation codebook that receives the adaptive excitation vector code from the CELP type speech encoder and takes one frame of samples as an adaptive excitation vector from past excitation signal samples specified by the adaptive excitation vector code;

a fixed excitation codebook that that receives the fixed excitation vector code from the CELP type speech encoder and generates a fixed excitation vector specified by the fixed excitation vector code;

an excitation vector generating section that generates an excitation vector by adding a vector obtained by multiplying the adaptive excitation vector gain and the adaptive excitation vector, and a vector obtained by multiplying the fixed excitation vector gain and the fixed excitation vector;

a high-frequency emphasis section that performs high-frequency emphasis processing on the excitation vector generated by said excitation vector generating section; and a synthesis filter that performs filter synthesis of the excitation vector output from the high-frequency emphasis section employing a set of filter coefficients to output decoded speech data, wherein the high frequency emphasis section comprises:

a high pass filter that receives the excitation vector generated by said excitation vector generating section and allows a high-frequency component of the excitation vector generated by said excitation vector generating section to pass;

a first log power calculator that calculates a log power of the excitation vector that has passed through the high pass filter;

an adder that performs processing that subtracts the excitation vector that has passed through the high pass filter from the excitation vector generated by said excitation vector generating section without passing through the high pass filter;

a second log power calculator that calculates the log power of the excitation vector output from the adder, from which the high frequency component is removed;

a power ratio calculator that calculates a ratio between the log powers calculated by the first and second log power calculators; and a coefficient calculator that calculates a value of an emphasis coefficient for multiplying the high frequency component of the excitation vector generated by said excitation vector generating section that causes the ratio between the log powers to be basically a constant value, wherein:

the high-frequency emphasis section performs high-frequency emphasis processing by multiplying a signal component that has passed through the high pass filter by the emphasis coefficient calculated by the coefficient calculator and adding a result thereof to the excitation vector generated by said excitation vector generating section, to obtain an addition result for outputting to the synthesis filter.

* * * * *

UNITED STATES PATENT AND TRADEMARK OFFICE

CERTIFICATE OF CORRECTION

PATENT NO. : 7,580,834 B2
APPLICATION NO. : 10/505100
DATED : August 25, 2009
INVENTOR(S) : Ehara et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1127 days.

Signed and Sealed this

Fourteenth Day of September, 2010

David J. Kappos

David J. Kappos
*Director of the United States Patent and Trademark Office*